US007692613B2

(12) United States Patent
Choi et al.

(10) Patent No.: US 7,692,613 B2
(45) Date of Patent: Apr. 6, 2010

(54) LIGHT EMITTING DEVICE INCLUDING PIXEL CIRCUITS WITH SWITCHES TURNED ON AND OFF ALTERNATELY IN A HORIZONTAL PERIOD

(75) Inventors: Sang Moo Choi, Suwon (KR); Hong Kwon Kim, Euiwang (KR); Oh Kyong Kwon, Seoul (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 1346 days.

(21) Appl. No.: 11/139,042

(22) Filed: May 25, 2005

(65) Prior Publication Data

US 2006/0139253 A1 Jun. 29, 2006

(30) Foreign Application Priority Data

Dec. 24, 2004 (KR) ..... 10-2004-0112519

(51) Int. Cl.
*G09G 3/32* (2006.01)

(52) U.S. Cl. ..... 345/82; 345/78

(58) Field of Classification Search ..... 345/204–215, 345/690–699, 76–83; 315/169.3
See application file for complete search history.

(56) References Cited

U.S. PATENT DOCUMENTS

2002/0089357 A1* 7/2002 Pae et al. ..... 327/112
2004/0100427 A1* 5/2004 Miyazawa ..... 345/76
2004/0145547 A1* 7/2004 Oh ..... 345/76
2004/0233141 A1* 11/2004 Matsumoto ..... 345/76
2005/0007357 A1* 1/2005 Yamashita et al. ..... 345/204
2005/0285825 A1* 12/2005 Eom et al. ..... 345/76

FOREIGN PATENT DOCUMENTS

JP 05-289107 11/1993
JP 2003-330412 11/2003
JP 2004-226960 8/2004
JP 2004-334163 11/2004

(Continued)

OTHER PUBLICATIONS

Patent Abstracts of Japan for Publication No. 2004-226960, Date of publication of application Aug. 12, 2004, in the name of Choon-Yul Oh.

(Continued)

*Primary Examiner*—Chanh Nguyen
*Assistant Examiner*—Long Pham
(74) *Attorney, Agent, or Firm*—Christie, Parker & Hale, LLP

(57) ABSTRACT

Circuits for a pixel in a light emitting display capable of displaying an image with desired brightness are described. The pixel circuit includes a driver to supply a pixel current to the light emitting device corresponding to a data signal supplied from a data line, a first switching unit coupled between the driver and the data line, and a second switching unit coupled between the data line and a common node formed between the driver and the light emitting device. The driver, in turn, includes a first transistor to generate the pixel current to be supplied from a first power line to the light emitting device, a first capacitor coupled between the first transistor and the first switching unit to be charged with a voltage corresponding to the threshold voltage of the first transistor, and a second capacitor to be charged with a voltage corresponding to the data signal.

17 Claims, 18 Drawing Sheets

FOREIGN PATENT DOCUMENTS

| | | |
|---|---|---|
| JP | 07-168155 | 7/1995 |
| JP | 2003-140613 | 5/2003 |

OTHER PUBLICATIONS

Patent Abstracts of Japan for Publication No. 2004-334163, Date of publication of application Nov. 25, 2004, in the name of Bo-Young Chung et al.

Japanese Office action dated Apr. 7, 2009, for corresponding Japanese application 2005-299222, noting listed references in this IDS (except for JP2004-226960 previously filed in an IDS dated May 25, 2005) (4 pgs.).

* cited by examiner

LIGHT EMITTING DEVICE INCLUDING PIXEL CIRCUITS WITH SWITCHES TURNED ON AND OFF ALTERNATELY IN A HORIZONTAL PERIOD

CROSS-REFERENCE TO RELATED APPLICATION

This application claims priority to and the benefit of Korean Patent Application No. 2004-112519, filed on Dec. 24, 2004, in the Korean Intellectual Property Office, the entire content of which is incorporated herein by reference.

BACKGROUND

1. Field of the Invention

The present invention relates to a pixel and a light emitting display including the pixel, and more particularly, to a pixel circuit and a light emitting display in which an image is displayed with desired brightness.

2. Discussion of Related Art

Various flat panel displays have recently been developed as alternatives to a relatively heavy and bulky cathode ray tube (CRT) display. The flat panel display includes a liquid crystal display (LCD), a field emission display (FED), a plasma display panel (PDP), a light emitting display (OLED), and similar devices.

Among the flat panel displays, the light emitting display can emit light for itself by electron-hole recombination. Such a light emitting display has advantages in that response time is relatively fast and power consumption is relatively low. Generally, the light emitting display employs a transistor provided in each pixel for supplying current corresponding to a data signal to a light emitting device, thereby allowing the light emitting device to emit light.

FIG. 1 illustrates a conventional light emitting display. A conventional light emitting display includes a pixel portion 30 including a plurality of pixels 40 formed in a region defined by intersection of scan lines S1 through Sn and data lines D1 through Dm; a scan driver 10 to drive the scan lines S1 through Sn; a data driver 20 to drive the data lines D1 through Dm; and a timing controller 50 to control the scan driver 10 and the data driver 20.

The timing controller 50 generates a data control signal DCS and a scan control signal SCS corresponding to an external synchronization signal. The data control signal DCS and the scan control signal SCS are supplied from the timing controller 50 to the data driver 20 and the scan driver 10, respectively. Further, the timing controller 50 supplies external data to the data driver 20.

The scan driver 10 receives the scan control signal SCS from the timing controller 50. The scan driver 10 generates scan signals on the basis of the scan control signal SCS and supplies the scan signals to the scan lines S1 through Sn.

The data driver 20 receives the data control signal DCS from the timing controller 50. The data driver 20 generates data signals on the basis of the data control signal DCS and supplies the data signals to the data lines D1 through Dm while synchronizing with the scan signals.

The display portion 30 receives first voltage ELVDD and second voltage ELVSS from an external power source, and supplies them to the respective pixels 40. When the first voltage ELVDD and the second voltage ELVSS are applied to the pixels 40, each pixel 40 controls a current corresponding to the data signal to flow from a first power line supplying the first voltage ELVDD to a second power line supplying the second voltage ELVSS via the light emitting device, thereby emitting light corresponding to the data signal.

That is, in the conventional light emitting display, each pixel 40 emits light with a predetermined constant brightness corresponding to the data signal, but cannot emit light with desired brightness because transistors provided in the respective pixels 40 are different in threshold voltage from one another. Further, in the conventional light emitting display, there is no method of measuring and controlling a real current flowing in each pixel 40 corresponding to the data signal.

SUMMARY OF THE INVENTION

Accordingly, it is an aspect of the present invention to provide a data driving integrated circuit to display an image with desired brightness, a light emitting display using the same, and a method of driving the light emitting display.

Embodiments of the present invention provide a pixel and a light emitting display including the same, in which a gradation current corresponding to data is compared with a pixel current flowing in a pixel, and the gradation current is adjusted to be approximately equal to the pixel current, thereby displaying an image with the desired brightness. Further, each pixel according to the embodiments of the present invention has a circuit to compensate for the threshold voltage of its transistors. As each pixel circuit compensates the threshold voltage of the transistor, a desired pixel current is generated.

The foregoing and/or other aspects of the present invention are achieved by providing a pixel circuit including a light emitting device, a driver to supply a pixel current to the light emitting device corresponding to a data signal supplied from a data line, a first switching unit coupled between the driver and the data line, turned on for a first period of a horizontal period, and turned on and off at least once for a second period of the horizontal period except for the first period, and a second switching unit coupled between the data line and a common node formed between the driver and the light emitting device, turned off for the first period, and turned on and off alternately with the first switching unit for the second period. The driver in turn includes a first transistor to generate the pixel current from a voltage supplied by a first power line, where the pixel current is generated corresponding to the data signal and is supplied from a first power line to the light emitting device, a first capacitor coupled between the first transistor and the first switching unit to be charged with a voltage corresponding to the threshold voltage of the first transistor, and a second capacitor to be charged with a voltage corresponding to the data signal.

In some embodiments, the data signal is supplied to the driver when the first switching unit is turned on, and the pixel current is supplied to the data line when the second switching unit is turned on.

The pixel circuit may be coupled to a first scan line coupled to the first switching unit, and supplying a first scan signal to control the first switching unit to be turned on during the first period and turned off and on at least once during the second period and a second scan line coupled to the second switching unit, and supplying a second scan signal to control the second switching unit to be turned off during the first period and turned on and off alternately with the first switching unit during the second period.

The driver circuit of the pixel circuit and the first and second switching units may have various embodiments. For example, the first switching unit may include a second transistor coupled between the data line and the driver and controlled by the first scan line and a third transistor coupled between the first transistor and the driver and controlled by the second scan line, the third transistor comprising a drain electrode and a source electrode which are electrically coupled to each other. Alternatively, the first switching unit may include a second transistor provided as a PMOS transistor and controlled by the first scan line; and a third transistor provided as a NMOS transistor coupled with the second transistor in a transmission gate form and controlled by the second scan line. This switching unit may further include a fourth transistor provided as a PMOS transistor and controlled by the second scan line, and a fifth transistor provided as a NMOS transistor coupled with the second transistor in a transmission gate form and controlled by the first scan line, a transmission gate formed by the fourth transistor and the fifth transistor coupled between the driver and a transmission gate formed by the second transistor and the third transistor.

In various embodiments of the driver, the second capacitor may be coupled between the first power line and a first node formed as a common node between the first capacitor and the first switching unit. The driver may further include a second transistor coupled between the first node and the first power line, the second transistor being turned on before the first scan signal and the second scan signal are supplied, and a third transistor coupled between a gate electrode of the first transistor and a second electrode of the first transistor, the third electrode being turned on when the second transistor is turned on. The pixel circuit having this switching circuit may further include a fourth transistor coupled between the driver and the light emitting device, the fourth transistor being turned off while the first scan signal is supplied and turned on otherwise.

DETAILED DESCRIPTION

Figure 1:
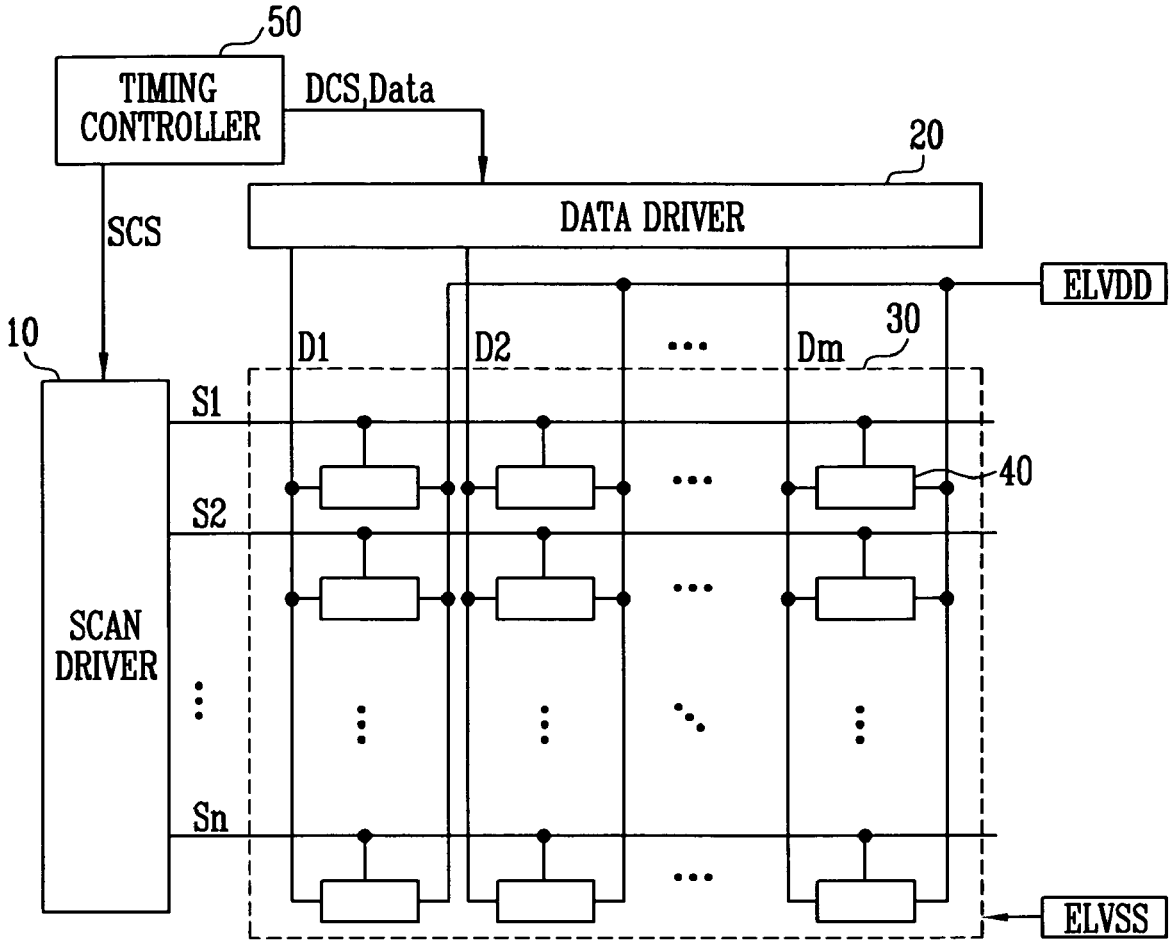
FIG. 1 (PRIOR ART)
FIG. 1 is a layout diagram showing a conventional light emitting display.
Figure 2:
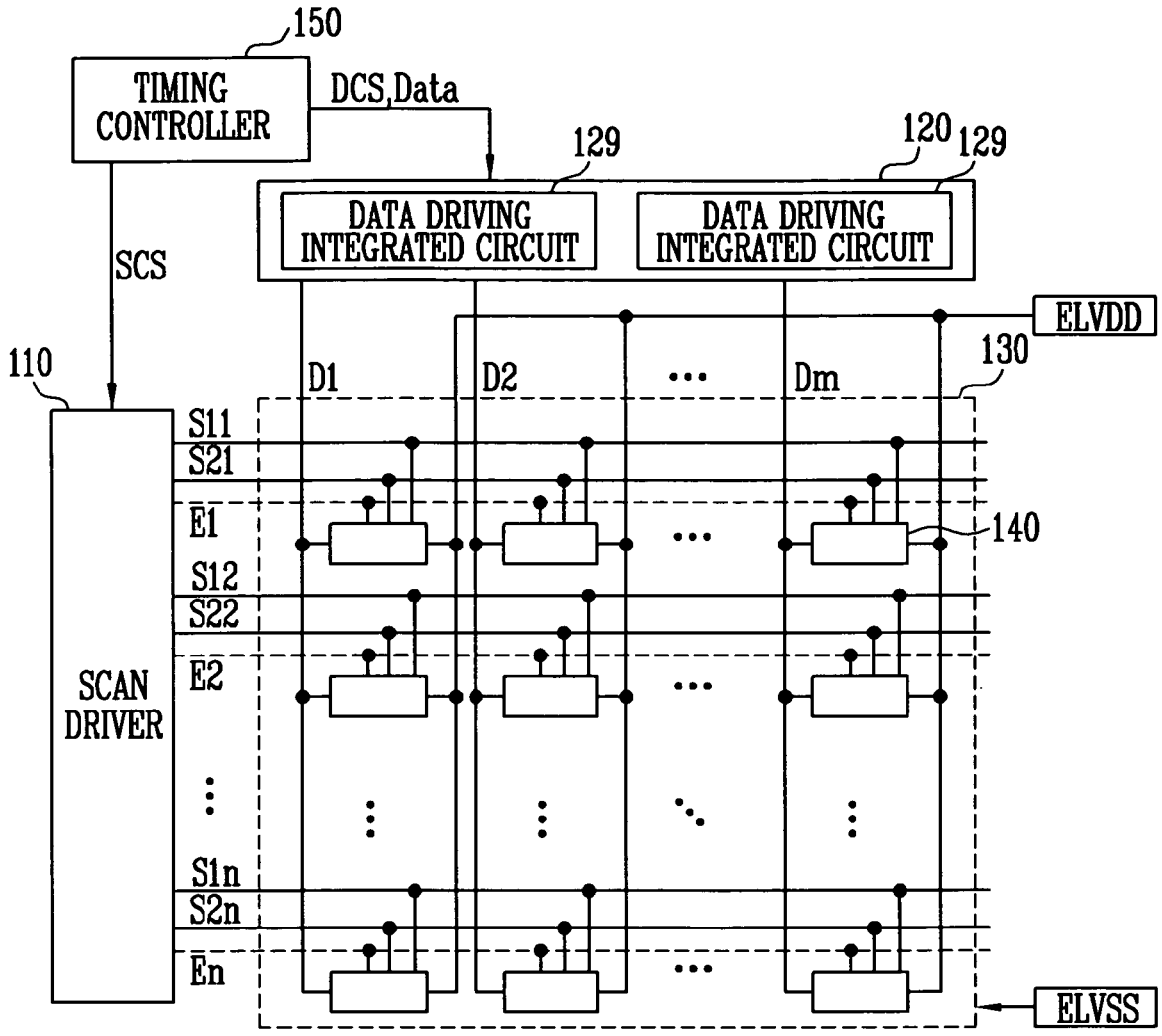
FIG. 2 is a layout diagram showing a light emitting display according to an embodiment of the present invention.

FIG. 2 illustrates a light emitting display according to an embodiment of the present invention. The light emitting display includes a pixel portion 130 including a plurality of pixels 140 formed in regions defined by first scan lines S11 through S1*n*, second scan lines S21 through S2*n*, emission control lines E1 through En, and data lines D1 through Dm; a scan driver 110 to drive the first scan lines S11 through S1*n*, the second scan lines S21 through S2*n*, and the emission control lines E1 through En; a data driver to drive the data lines D1 through Dm; and a timing controller 150 to control the scan driver 110 and the data driver 120.

The pixel portion 130 includes the plurality of pixels 140 formed in regions defined by the first scan lines S11 through S1*n*, the second scan lines S21 through S2*n*, the emission control lines E1 through En, and the data lines D1 through Dm. The pixels 140 receive external first and second voltages ELVDD, ELVSS. When the first voltage ELVDD and the second voltage ELVSS are applied to the pixels 140, each pixel 140 controls a pixel current flowing from a first power line supplying the first voltage ELVDD to a second power line supplying the second voltage ELVSS via a light emitting device corresponding to a data signal transmitted through the data line D. Further, the pixel 140 supplies the pixel current to the data driver 120 via the data line D for a partial horizontal period. The configuration of each pixel 140 will be described later.

The timing controller 150 generates a data control signal DCS and a scan control signal SCS in response to external synchronization signals. The timing controller 150 supplies the data control signal DCS and the scan control signal SCS to the data driver 120 and the scan driver 110, respectively. Further, the timing controller 150 supplies external data Data to the data driver 120.

The scan driver 110 receives the scan control signal SCS from the timing controller 150. In response to the scan control signal SCS, the scan driver 110 sequentially supplies first scan signals to the first scan lines S11 through S1*n*, and at the same time sequentially supplies second scan signals to the second scan lines S21 through S2*n*.

Figure 3:
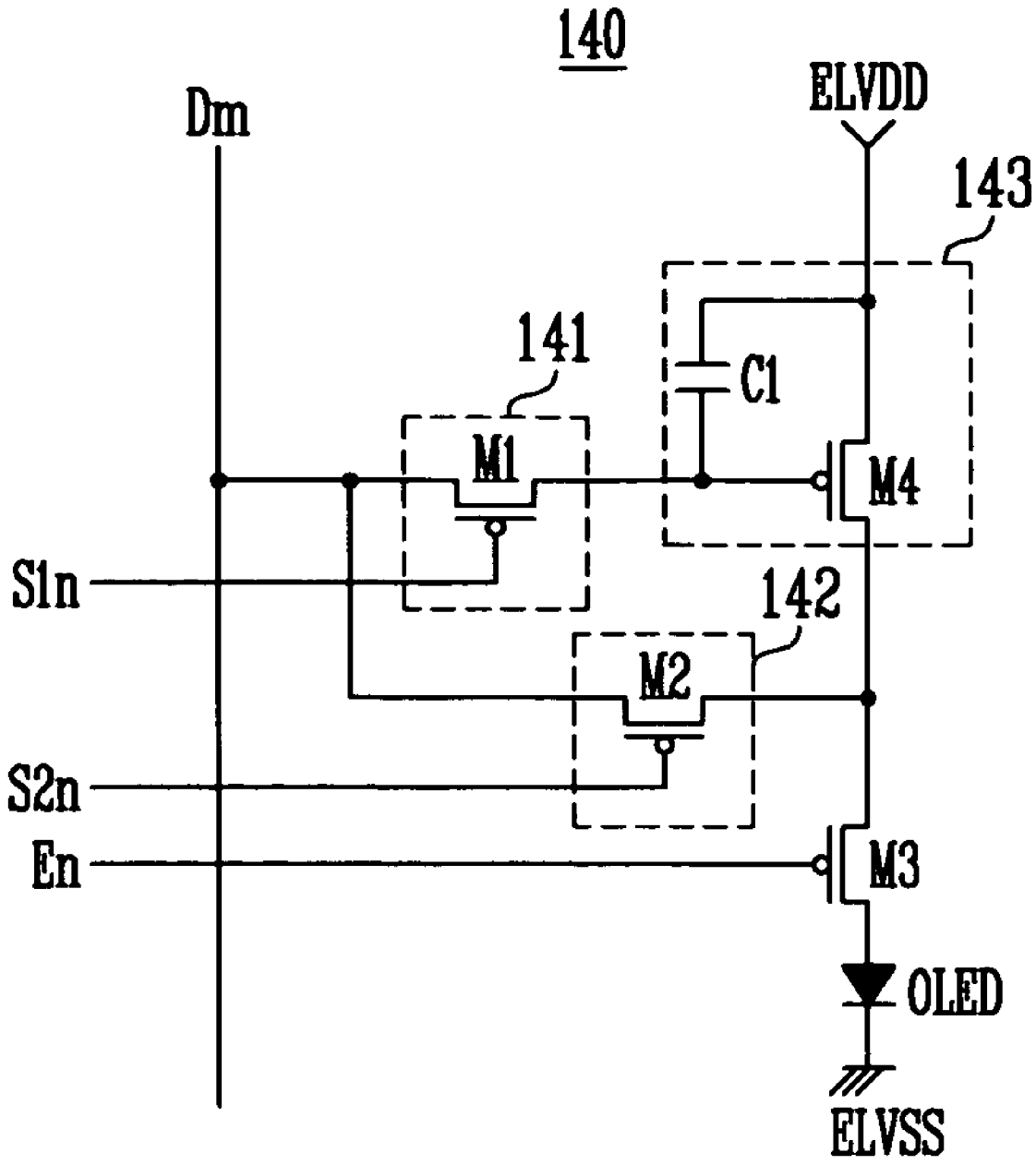
FIG. 3 is a circuit diagram illustrating a first embodiment of a pixel illustrated in FIG. 2.
Figure 4:
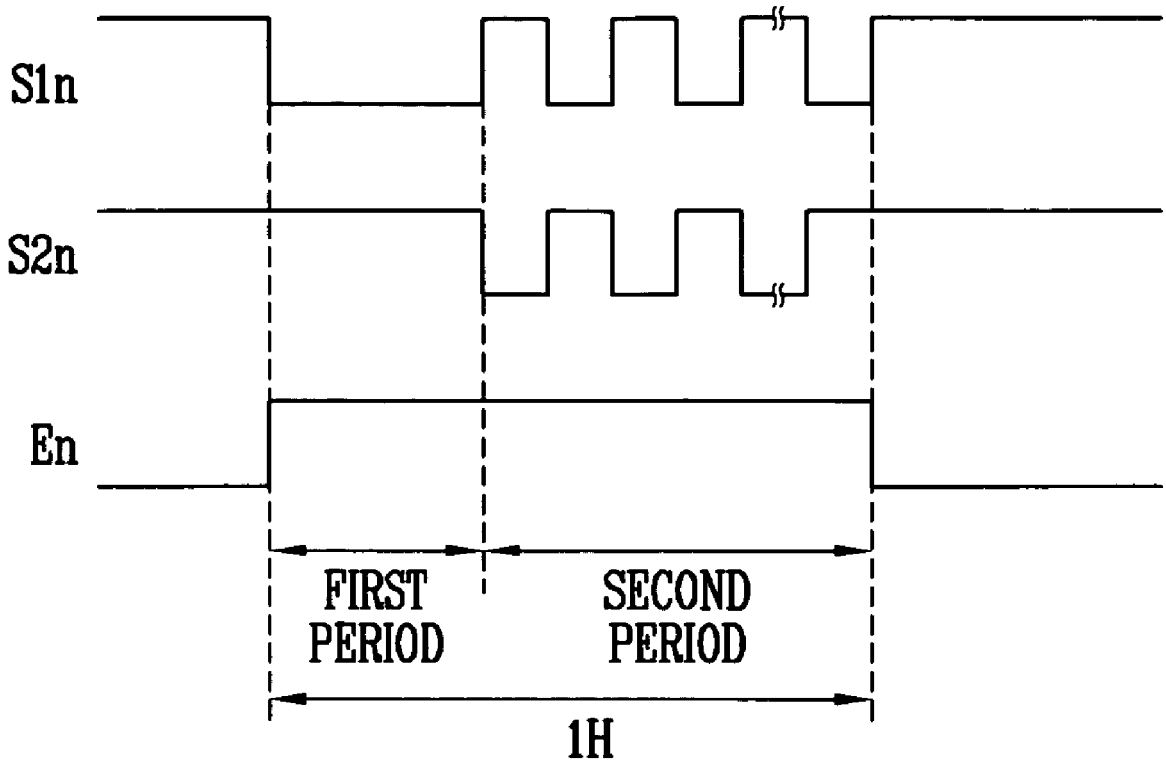
FIG. 4 shows waveforms of signals for driving the pixel illustrated in FIG. 3.

FIG. 3 is a circuit diagram illustrating a first embodiment of a pixel illustrated in FIG. 2. FIG. 4 shows waveforms of signals for driving the pixel illustrated in FIG. 3.

As shown in FIGS. 3 and 4, the scan driver 110 supplies a first scan signal to turn on a first transistor M1 provided in the pixel 140 for a first period of one horizontal period 1H, and to repeatedly turn on and off the first transistor M1 for a second period of the one horizontal period 1H. Further, the scan driver 110 supplies a second scan signal to turn off a second transistor M2 provided in the pixel 140 for the first period of one horizontal period 1H, and to repeatedly turn on and off the second transistor M2 alternately with the first transistor M1. Also, the scan driver 110 supplies an emission control signal to turn off a third transistor M3 provided in the pixel 140 for a predetermined horizontal period during which the first and second scan signals are being supplied with the first scan signal and the second scan signal, and to turn on the third transistor M3 during other times. According to an embodiment of the present invention, the emission control signal is supplied overlapping with the first and second scan signals, and has a width equal to or larger than that of the first scan signal. In the embodiment shown on FIG. 4, the width or duration of the emission control signal is equal to the one horizontal period 1H which is equal to the duration of the first scan signal applied to the first scan line S1*n*.

The data driver 120 receives the data control signal DCS from the timing controller 150. Then, the data driver 120 generates the data signal in response to the data control signal DCS, and supplies the data signal to the data lines D1 through Dm. Here, the data driver 120 supplies a predetermined constant gradation voltage as the data signal to the data lines D1 through Dm.

Here, the data driver 120 receives a pixel current from the pixel 140 during a part of the second period of the one horizontal period 1H, and checks whether the received pixel current has a level corresponding to the data Data. For example, when a pixel current flowing in the pixel 140 corresponding to a bit value (or gradation level) of the data Data is 10 μA, the data driver 120 checks whether the received pixel current is 10 μA. When the data driver 120 receives an undesired current from each pixel 140, the data driver 120 adjusts the gradation voltage, thereby allowing a desired current to flow in each pixel 140. Here, the data driver 120 includes at least one data driving integrated circuit 129 having j channels (where, j is a natural number). Detailed configuration of the data driving integrated circuit 129 will be described later.

FIG. 3 is now described in further detail. For the sake of convenience, FIG. 3 exemplarily illustrates a pixel that is coupled to the $m^{th}$ data line Dm, the $n^{th}$ first scan line S1*n*, the $n^{th}$ second scan line S2*n*, and the $n^{th}$ emission control line En. In FIG. 3, transistors M1 through M4 are illustrated as p-channel metal oxide semiconductor (PMOS) transistors, but the invention is not limited to the use of PMOS transistors.

Referring to FIG. 3, the pixel 140 according to the first embodiment of the present invention includes a light emitting device OLED, a first switching unit 141, a second switching unit 142, a driver 143, and a third transistor M3.

The first switching unit 141 is coupled between the data line Dm and a driver 143, and supplies the gradation voltage from the data line Dm to the driver 143. Here, the first switching unit 141 includes at least one transistor. For example, the first switching unit 141 includes one first transistor M1 that is controlled by the first scan signal transmitted to the $n^{th}$ first scan line S1*n*.

The second switching unit 142 is coupled between a data line Dm and a common node formed between the driver 143 and the light emitting device OLED, and supplies the pixel current from the driver 143 to the data line Dm. Here, the second switching unit 142 includes at least one transistor. For example, the second switching unit 142 includes one second transistor M2 that is controlled by the second scan signal transmitted to the $n^{th}$ second scan line S2*n*.

The third transistor M3 is coupled between the driver 143 and the light emitting device OLED. Here, the third transistor M3 is controlled by the emission control signal transmitted from the $n^{th}$ emission control line En. The third transistor M3 is substantially turned off during a period while the emission control signal is supplied, and turned on otherwise.

The driver 143 supplies the pixel current to the second transistor M2 and the third transistor M3 while the amount of pixel current supplied will correspond to the gradation voltage received by the driver 143 from the first transistor M1. Here, the driver 143 includes a fourth transistor M4 coupled between a first power line supplying the first voltage ELVDD and the third transistor M3, and a first capacitor C1 coupled between a gate electrode of the fourth transistor M4 and the first power line supplying the first voltage ELVDD. The first capacitor C1 charges a to a constant voltage corresponding to the gradation voltage. As a result, the fourth transistor M4 supplies the pixel current corresponding to the voltage charged in the first capacitor C1.

Referring to FIGS. 3 and 4, the pixel 140 operates as follows. For a predetermined horizontal period of one frame, the first scan signal is supplied through the $n^{th}$ first scan line S1*n*, and at the same time, the second scan signal is supplied through the $n^{th}$ second scan line S2*n*.

The first transistor M1 receives the first scan signal and is turned on for the first period of one horizontal period 1H. As the first transistor M1 is turned on, the data signal, i.e. the gradation voltage, of the data line Dm is supplied to the first capacitor C1 for the duration of the first period. As a result, the first capacitor C1 is charged with a predetermined constant voltage corresponding to the data signal. In the meanwhile, the second transistor M2 receives the second scan signal and stays off during the first period.

Then, the first transistor M1 is turned off and the second transistor M2 is turned on for a part of the second period. As the second transistor M2 is turned on, the pixel current, corresponding to the voltage charged in the first capacitor C1, is supplied from the fourth transistor M4 to the data line Dm. The pixel current is supplied from the data line Dm to the data driver 120, and the data driver 120 increases or decreases the level of the gradation voltage in accordance with the pixel current received. In turn, this gradation voltage will be supplied as the data signal to the first capacitor C1, thereby allowing a desired pixel current to flow in the pixel 140. Next, the second transistor M2 is turned off, and the first transistor M1 is turned on. As the first transistor M1 is turned on, the gradation voltage increased or decreased by the data driver 120 is supplied as the data signal to the first capacitor C1, thereby controlling the level of the voltage charged in the first capacitor C1. In effect, the first transistor M1 and the second transistor M2 are alternately turned on and off at least once for the second period, so that the voltage charged in the first capacitor C1 is varied to allow the desired pixel current to flow in the pixel 140.

As explained above, the first capacitor C1 is charged by the data signal received from the data line Dm while the first transistor M1 is on and the second transistor M2 is off. Subsequently, while the second transistor M2 is on and the first transistor M1 is off, the first capacitor C1 is discharged through the second transistor M2 sending the pixel current through the second transistor M2 to the data driver 120 which adjusts the next data signal according to the pixel current received and sends it back to the first capacitor C1 during the next cycle when the first transistor M1 is on again and the second transistor M2 is off.

Figure 5:
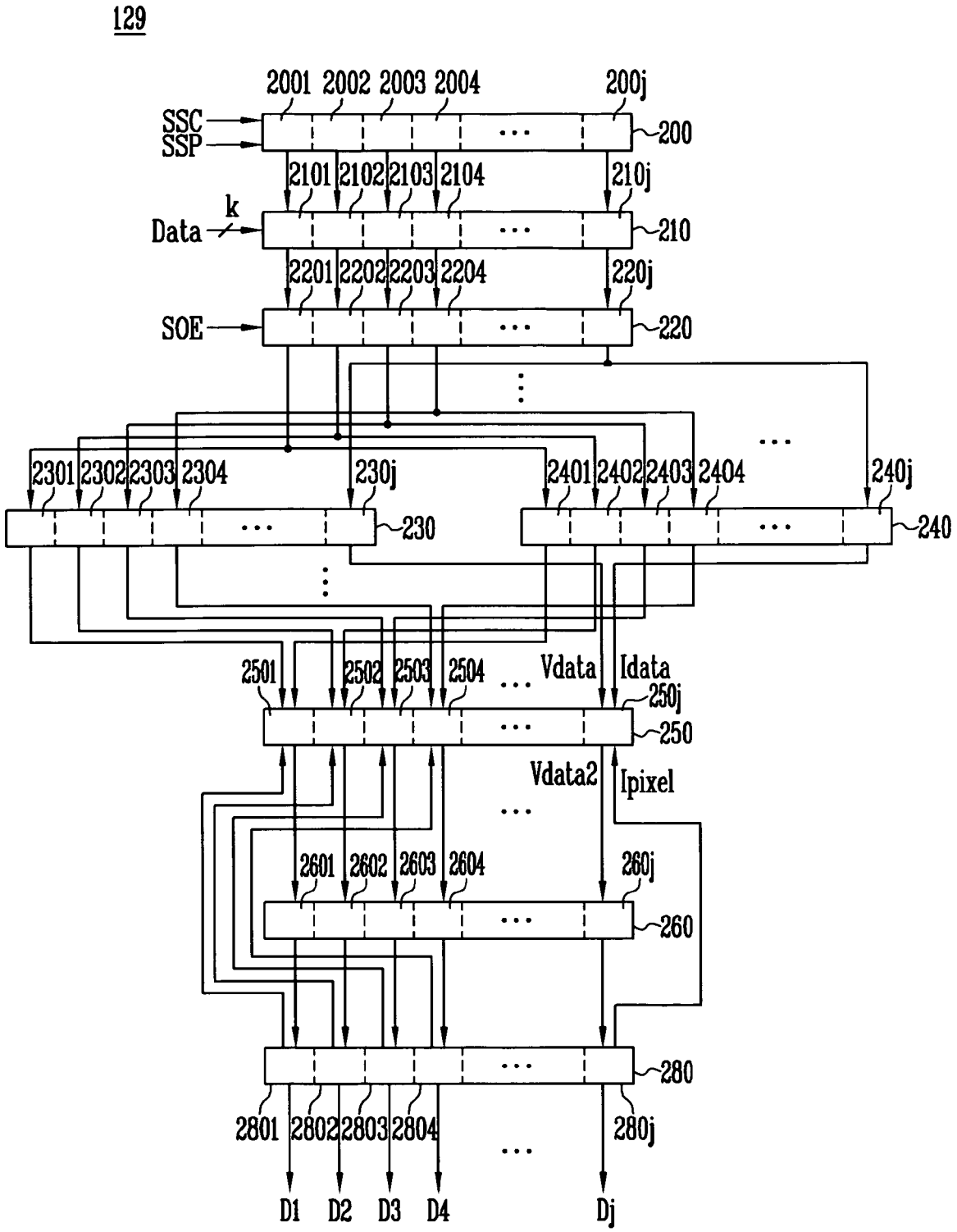
FIG. 5 is a block diagram showing an embodiment of a data driving integrated circuit illustrated in FIG. 2.

FIG. 5 is a block diagram showing an embodiment of a data driving integrated circuit illustrated in FIG. 2. For the sake of convenience, FIG. 5 exemplarily illustrates a pixel integrated circuit 129 having j channels.

Referring to FIG. 5, the data driving integrated circuit 129 includes a shift register part 200 to generate sampling signals in sequence, a sampling latch part 210 to store the data Data in sequence in response to the sampling signals, a holding latch part 220 to temporarily store the data Data of the sampling latch part 210 and supply the stored data Data to a voltage digital-analog converter (VDAC) 230 to generate the gradation voltage Vdata corresponding to a gradation level of the data Data, a current digital-analog converter (IDAC) 240 to generate the gradation current Idata corresponding to the gradation level of the data Data, a voltage control unit 250 to control a gradation voltage Vdata corresponding to the pixel current Ipixel supplied through the data lines D1 through Dj, a buffer part 260 to supply the gradation voltage Vdata from the voltage control unit 250 to the data lines D1 through Dj, and a selection unit 280 to selectively couple the data lines D1 through Dj with either of the buffer part 260 or the voltage control unit 250.

The shift register part 200 receives a source shift clock SSC and a source start pulse SSP from the timing controller 150 and shifts the source start pulse SSP per period of the source shift clock SSC, thereby generating j sampling signals in sequence. In the example shown in FIG. 5, the shift register part 200 includes j shift registers 2001 through 200*j*.

The sampling latch part 210 stores the data Data in sequence in response to the sampling signals sequentially supplied from the shift register part 200. In the example shown in FIG. 5, the sampling latch part 210 includes j sampling latches 2101 through 210*j* to store j data Data. Further, the size of each sampling latches 2101 through 210*j* corresponds to a bit value of the data Data. For example, in the case where the data Data is of k bits, each of the sampling latches 2101 through 210*j* has a size corresponding to k bits.

The holding latch part 220 receives the data Data from the sampling latch part 210 and stores it in response to a source output enable signal SOE. Further, the holding latch part 220 supplies the data Data stored in the holding latch part 220 to the VDAC 230 and the IDAC 240 in response to the source output enable signal SOE. In the example shown in FIG. 5, the holding latch part 220 includes j holding latches 2201 through 220*j* each capable of storing k bits.

The VDAC 230 generates the gradation voltage Vdata corresponding to the bit value (i.e., gradation level) of the data Data, and supplies the gradation voltage Vdata to the voltage control unit 250. In the example shown in FIG. 5, the VDAC 230 generates j gradation voltages Vdata corresponding to j data Data supplied from the holding latch part 220. Thus, the VDAC 230 includes j voltage generators 2301 through 230*j*. For the sake of convenience, the gradation voltage Vdata generated by the VDAC 230 will be called a first gradation voltage Vdata.

The IDAC 240 generates the gradation current Idata corresponding to the bit value of the data Data, and supplies the gradation current to the voltage control unit 250. Here, the IDAC 240 generates j gradation currents Idata corresponding to j data Data supplied from the holding latch part 220. Thus, the IDAC 240 includes j current generators 2401 through 240*j*.

The voltage control unit 250 receives the first gradation voltage Vdata, the gradation current Idata, and the pixel current Ipixel. The voltage control unit 250 compares the gradation current Idata with the pixel current Ipixel, and on the basis of difference between the gradation current Idata and the pixel current Ipixel, controls the level of the first gradation voltage Vdata. Hereinafter, for the sake of convenience, the first gradation voltage Vdata controlled by the voltage control unit 250 will be called a second gradation voltage Vdata2. The voltage control unit 250 adjusts the level of the second gradation voltage Vdata2 to make the gradation current Idata equal to the pixel current Ipixel. In the example shown in FIG. 5, the voltage control unit 250 includes j voltage controllers 2501 through 250*j*.

The buffer part 260 supplies the first gradation voltage Vdata or the second gradation voltage Vdata2 from the voltage control unit 250 to j data lines D1 through Dj. In the example shown in FIG. 5, the buffer part 260 includes j buffers 2601 through 260*j*.

The selection unit 280 selectively couples the data lines D1 through Dj to either of the buffer part 260 or the voltage control unit 250. In the example shown in FIG. 5, the selection unit 280 includes j selectors 2801 through 280*j*.

Figure 6:
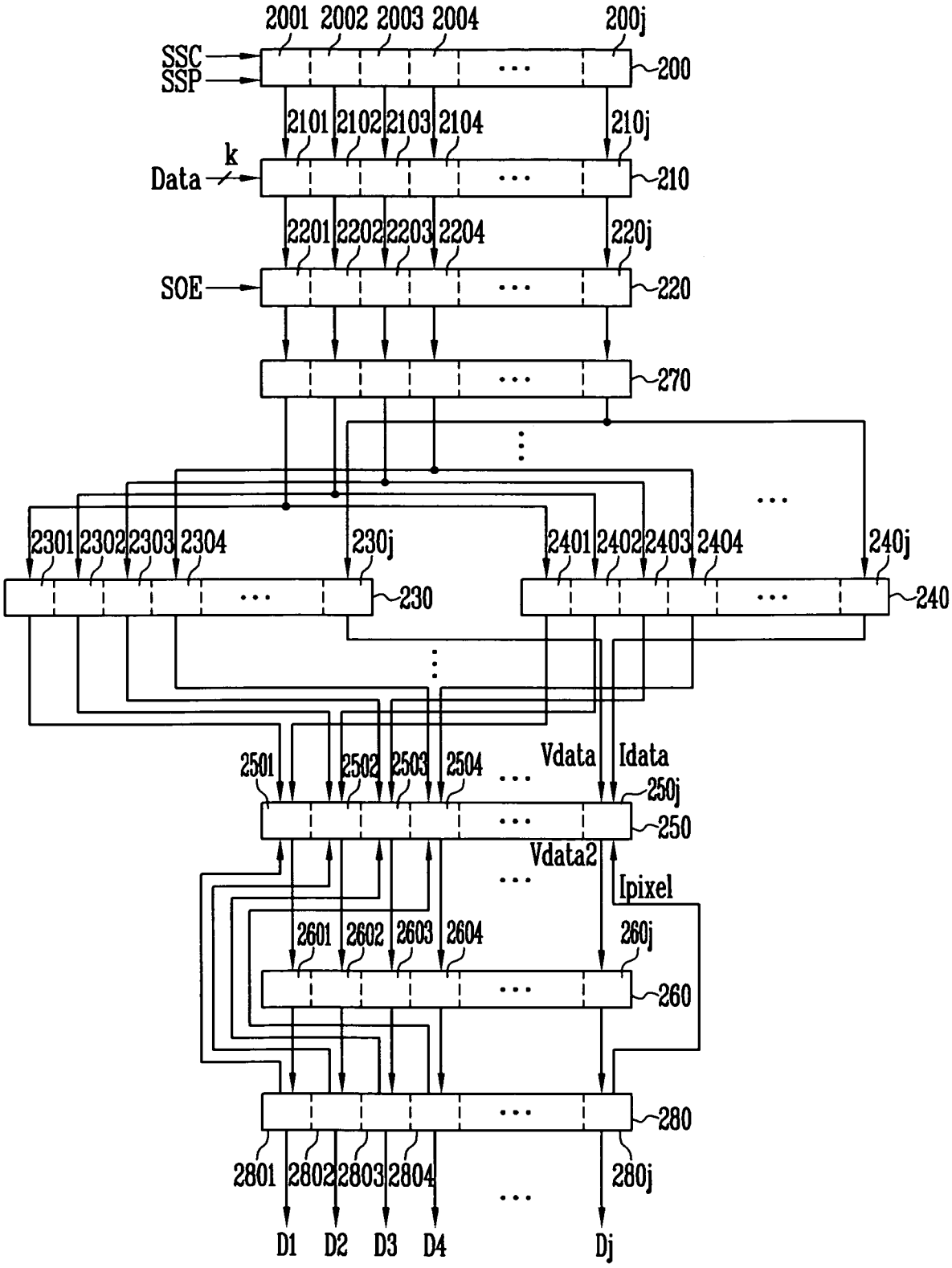
FIG. 6 is a block diagram showing another embodiment of the data driving integrated circuit illustrated in FIG. 2.

FIG. 6 shows another embodiment of the present invention, where the data driving integrated circuit 129 further includes a level shifter part 270 between the holding latch part 220 and both the VDAC 230 and IDAC 240. The level shifter part 270 increases the voltage level of the data Data supplied from the holding latch part 220, and supplies it to the VDAC 230 and the IDAC 240. If the data Data having a high voltage level is directly supplied from an external system to the data driving integrated circuit 129, additional circuit elements capable of handling the high voltage level are required that increase the production cost. However, with the inclusion of the level shifter part 270, the data Data may be supplied by the external system to the data driving integrated circuit 129 at a low voltage level that is subsequently increased to a higher level by the level shifter part 270. As a result, circuit elements capable of handling external inputs of high voltage level are not additionally needed, thereby reducing the production cost. In the example shown in FIG. 6, the level shifter part 270 includes j level shifters 2701 through 270*j*.

Figure 7:
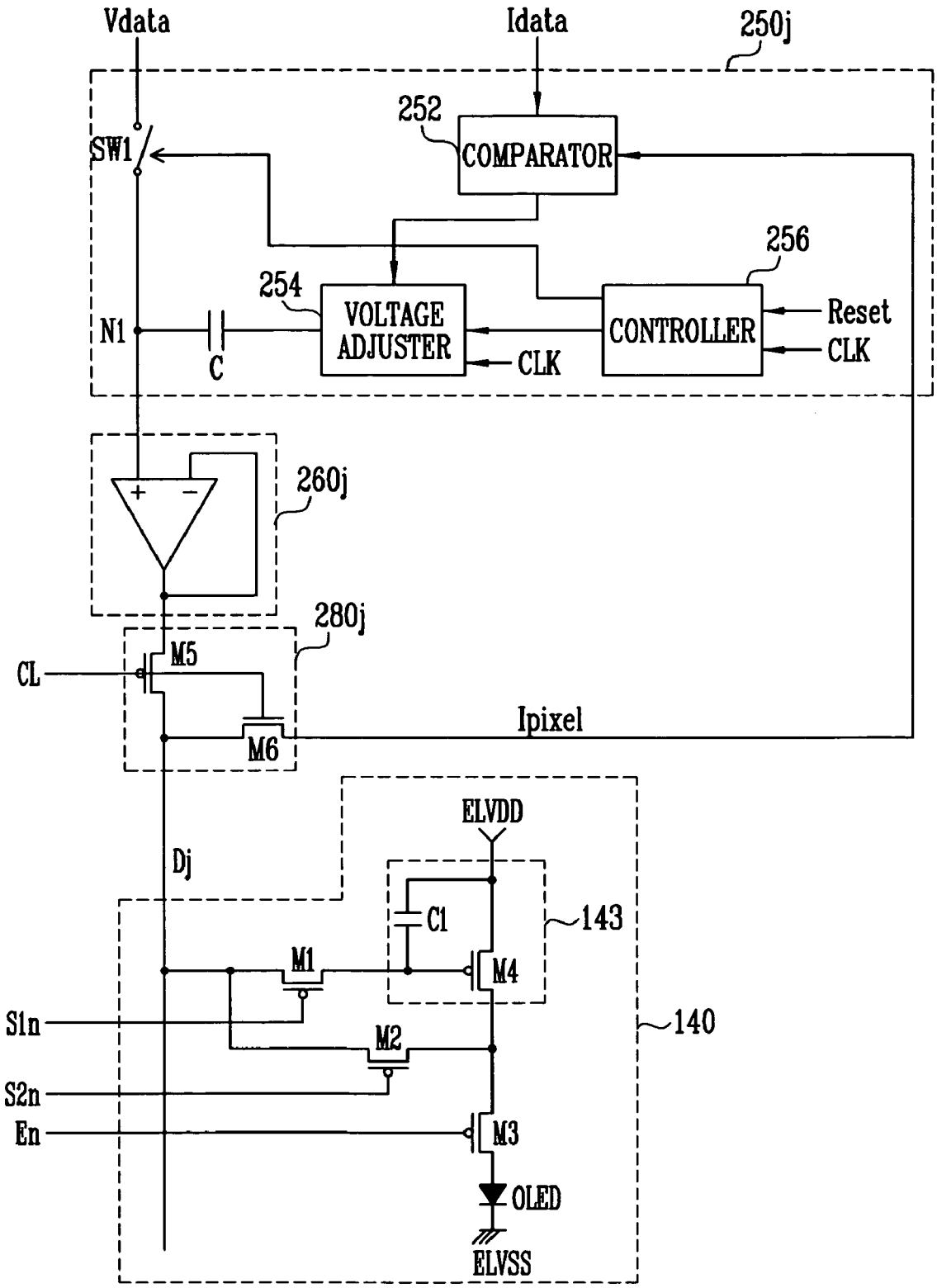
FIG. 7 is a detailed block diagram of a voltage controller and a selector provided in the data driving integrated circuit illustrated in FIGS. 3 and 4.

FIG. 7 is a circuit diagram showing the internal circuit of one of the voltage controllers 2501 to 250*j* and one of the selectors 2801 to 280*j* illustrated in FIG. 5. For the sake of convenience, FIG. 7 exemplarily illustrates the $j^{th}$ voltage controller 250*j* and the $j^{th}$ selector 280*j*. The buffer 260*j* and the pixel 140 are also shown in this figure.

Referring to FIG. 7, the selector 280*j* includes a fifth transistor M5 coupled between the buffer 260*j* and the data line Dj, and a sixth transistor M6 coupled between the voltage controller 250*j* and the data line Dj. Here, the fifth transistor M5 and the sixth transistor M6 are turned on alternately with each other, and couple the data line Dj with either of the buffer 260*j* or the voltage controller 250*j*. To achieve this alternate turning on and off, the fifth transistor M5 and the sixth transistor M6 are different in conductivity type. For example, if one is a PMOS, the other would be an NMOS. Here, the fifth transistor M5 and the sixth transistor M6 are both controlled by a selection signal supplied through a control line CL.

Figure 8:
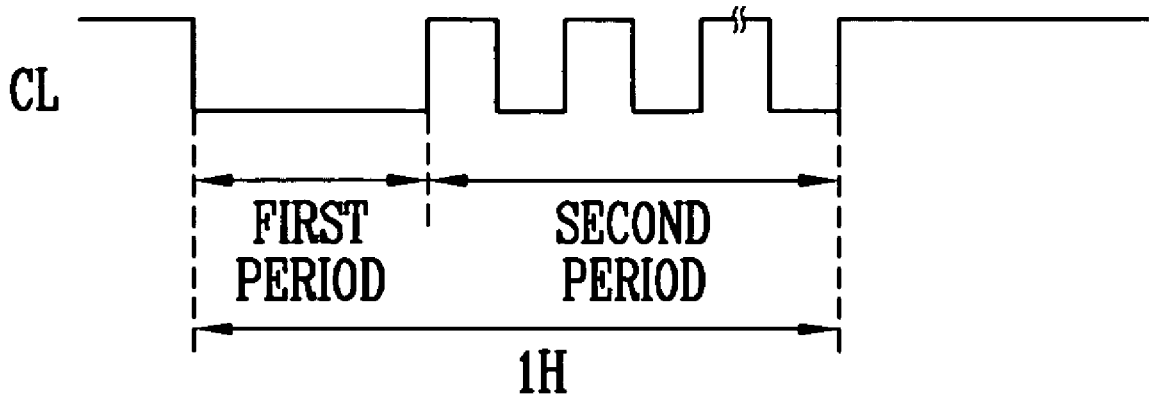
FIG. 8 shows a waveform of a selection signal supplied to the selector illustrated in FIG. 7.

FIG. 8 shows a waveform of the selection signal CL supplied to the selector 280*j* of FIG. 7. As shown in FIG. 8, the selection signal CL is supplied during the first period of the one horizontal period 1H to turn on the fifth transistor M5. In the example shown in FIG. 7, the fifth transistor M5 is depicted as a PMOS transistor therefore requiring a low voltage at its gate in order to be on. During the second period of the one horizontal period 1H, the selection signal CL is supplied to turn on and off the fifth and sixth transistors M5 and M6 alternately with each other. During this period, if the fifth transistor M5 is on, the sixth transistor M6 is off and vice versa. During the second period, the selection signal CL is supplied to turn on and off the fifth transistor M5 in accordance with the first transistor M1, and to turn on and off the sixth transistor M6 in accordance with the second transistor M2.

The voltage controller 250*j* includes a comparator 252, a voltage adjuster 254, a controller 256, a capacitor C, and a switching device SW1. The switching device SW1 is coupled between the VDAC 230 and the buffer 260*j*. Further, the switching device SW1 is controlled by the controller 256. The controller 256 turns on the switching device SW1 for the first period and turns it off for the second period.

The capacitor C is coupled between the voltage adjuster 254 and a first node N1 formed as a common node between the switching device SW1 and the buffer part 260*j*. The capacitor C increases or decreases the level of voltage applied to the first node N1 corresponding to the voltage supplied from the voltage adjuster 254. For instance, when the voltage adjuster 254 supplies a high level of voltage to the capacitor C, the voltage applied to the first node N1 is increased by the capacitor C. On the other hand, when the voltage adjuster 254 supplies a low level of voltage, the voltage applied to the first node N1 is decreased by the capacitor C.

The comparator 252 receives the gradation current Idata from the IDAC 240 and receives the pixel current Ipixel from the pixel 140 via the data line Dj and the selector 280*j*. The pixel current Ipixel is supplied from the pixel 140 that receives the first and second scan signals. Once the comparator 252 receives the gradation current Idata and the pixel current Ipixel, and compares the gradation current Idata with the pixel current Ipixel, the comparator 252 may supply first and second control signals corresponding to the results of the comparison to the voltage adjuster 254. For example, the comparator 252 generates the first control signal when the gradation current Idata is higher than the pixel current Ipixel and the second control signal when the gradation current Idata is lower than the pixel current Ipixel.

The voltage adjuster 254 applies a predetermined constant voltage to the capacitor C on the basis of the first and second control signals supplied from the comparator 252. The voltage adjuster 254 supplies an amount of voltage to the capacitor C that causes the pixel current Ipixel to be approximately equal to the gradation current Idata. As a result, the voltage applied to the first node N1 is increased or decreased depending on the voltage supplied to the capacitor C. The increased or decreased voltage of the first node N1 is used as the second gradation voltage Vdata2.

The controller 256 turns on the switching device SW1 for the first period of one horizontal period 1H, and turns off the switching device SW1 for the second period. Further, the controller 256 supplies a counting signal to the voltage adjuster 254 and the counting signal is gradually increased during the second period. For example, the controller 256 supplies the counting signal to the voltage adjuster 254 and the counting signal increases from "1" to "I," where "I" is a natural number. Therefore, the controller 256 may include a counter (not shown). The counting signal of the controller 256 is initialized in response to a reset signal. The reset signal is set to be supplied per each of the one horizontal period 1H. For example, a horizontal synchronous signal H or a scan signal can be used as the reset signal.

The voltage controller according to one embodiment of the present invention operates as follows. First, the switching device SW1, the fifth transistor M5, and the first transistor M1 are turned on for the first period of the one horizontal period 1H. When the switching device SW1 is turned on, the first gradation voltage Vdata is supplied from the VDAC 230 (FIGS. 5 and 6) to the data line Dj via the buffer 260*j* and the fifth transistor M5. Then, the first gradation voltage Vdata is supplied from the data line Dj to the pixel 140 selected by the scan signal. That is, the first gradation voltage Vdata is supplied from the data line Dj to the driver 143 via the first transistor M1 turned on by the first scan signal. Then, the first capacitor C1 of the driver 143 is charged with a voltage corresponding to the first gradation voltage Vdata. In essence, the first period is set to allow the first capacitor C1 of the pixel 140 to be charged with a predetermined constant voltage corresponding to the first gradation voltage Vdata.

After the first capacitor C1 of the pixel 140 is charged with the voltage corresponding to the first gradation voltage Vdata, at the beginning of the second period, the sixth and second transistors M6 and M2 are turned on, and the switching device SW1 and the fifth and first transistors M5 and M1 are turned off.

As the switching device SW1 is turned off, the first node is in a floating state. At this time, the voltage applied to the first node is maintained as the first gradation voltage Vdata by a parasitic capacitor (not shown) or the like. Further, the second transistor M2 is turned on and the pixel current Ipixel generated by the driver 143 of the pixel 140 is supplied to the comparator 252 via the second transistor M2, the data line Dj and the sixth transistor M6.

The comparator 252 receives the pixel current Ipixel and compares the pixel current Ipixel with the gradation current Idata supplied from the IDAC 240 (FIGS. 5, 6), and outputs the first and second control signals to the voltage adjuster 254 on the basis of the results of the comparison. The gradation current Idata is an ideal current that should flow through the pixel 140 corresponding to the data Data, and the pixel current Ipixel is the real current that flows through the pixel 140.

For the second period, the controller 256 supplies the counting signal, which increases from "1" to "I", to the voltage adjuster 254. The voltage adjuster 254 receives the counting signal and supplies a predetermined constant voltage corresponding to the first or second control signals of the comparator 252 to the first capacitor C1. Here, the voltage adjuster 254 adjusts the voltage supplied to the first capacitor C1 on the basis of the first or second control signal so that the gradation current Idata and the pixel current Ipixel are approximately equal to each other. The voltage applied to the first node N1 varies according to the voltage supplied to the first capacitor C1, thereby generating the second gradation voltage Vdata2.

After the second gradation voltage Vdata2 is generated, the sixth and second transistors M6, M2 are turned off, and the fifth and first transistors M5, M1 are turned on. When the fifth transistor M5 and the first transistor M1 are turned on, the second gradation voltage Vdata2 applied to the first node N1 is supplied to the pixel 140. The pixel 140 generates the pixel current Ipixel corresponding to the second gradation voltage Vdata2. According to an embodiment of the present invention, the sixth and second transistors M2, M6 are turned on and off alternately with the fifth and first transistors M1, M5 at least one time during the second period, in order to assure that the gradation current Idata is similar or equal to the pixel current Ipixel.

Figure 9:
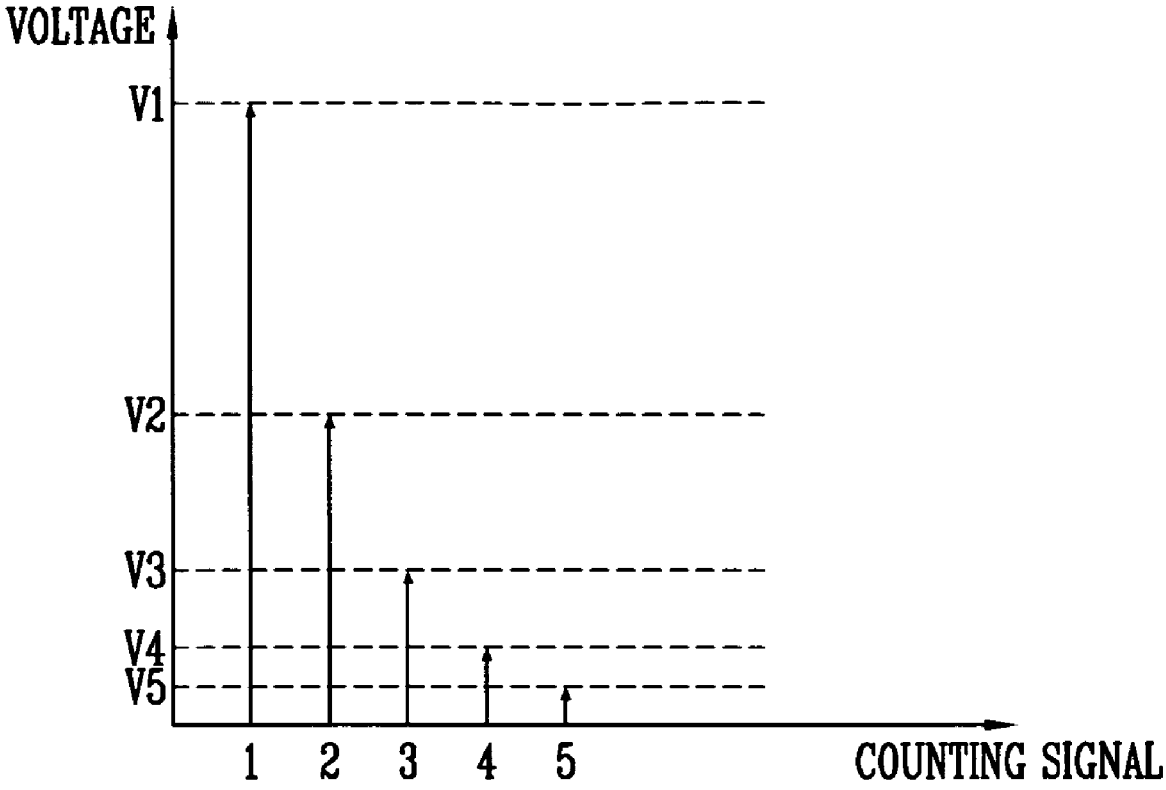
FIG. 9 is a graph showing a voltage range controlled by a voltage adjuster part of the voltage controller illustrated in FIG. 7.

FIG. 9 is a graph showing a voltage range controlled by a voltage adjuster 254 of the voltage controller 256 illustrated in FIG. 7. An adjustable range of the voltage adjusted by the voltage adjuster 254 is determined by the counting signal. For example, when the voltage adjuster 254 receives the first counting signal (e.g., "1"), the voltage adjuster 254 adjusts the voltage within the range of a first voltage V1 shown in FIG. 9. That is, when the first counting signal is supplied, the voltage is increased or decreased by a voltage of V1/2. Further, when the voltage adjuster 254 receives the second counting signal (e.g., "2"), the voltage adjuster 254 adjusts the voltage within the range of a second voltage V2 lower than the first voltage V1. That is, when the second counting signal is supplied, the voltage is increased or decreased by a voltage of V2/2. In the example shown in FIG. 9, the second voltage V2 is set as about half of the first voltage V1. Also, when the voltage adjuster 254 receives the third counting signal (e.g., "3"), the voltage adjuster 254 adjusts the voltage within the range of a third voltage V3 lower than the second voltage V2. Thus, the higher the counting signal, the smaller the adjustable range of the voltage adjusted by the voltage adjuster 254. In this example, the adjustable voltage range is halved with each increasing count. Similarly, the voltage adjuster 254 adjusts the voltage supplied to the first capacitor C1 in order to assure that the gradation current Idata is similar or equal to the pixel current Ipixel.

The driver 143 of the pixel 140 illustrated in FIG. 3 cannot compensate the threshold voltage of the fourth transistor M4. In the case where the driver 143 of the pixel 140 is configured as shown in FIG. 3, even when the data signal (the first gradation voltage Vdata or the second gradation voltage Vdata2) having a desired voltage level is supplied, the voltage level of the data signal varies according to the threshold voltage of the fourth transistor M4. As a result, it takes a relatively long time to make a desired pixel current Ipixel flow through the pixel 140 and a desired pixel current Ipixel may not flow through the pixel 140 during the second period of one horizontal period 1H. To solve this problem, the present invention proposes a pixel 140, with an alternative circuit shown in FIG. 10, which can generate the pixel current Ipixel regardless of the threshold voltage of the transistor.

Figure 10:
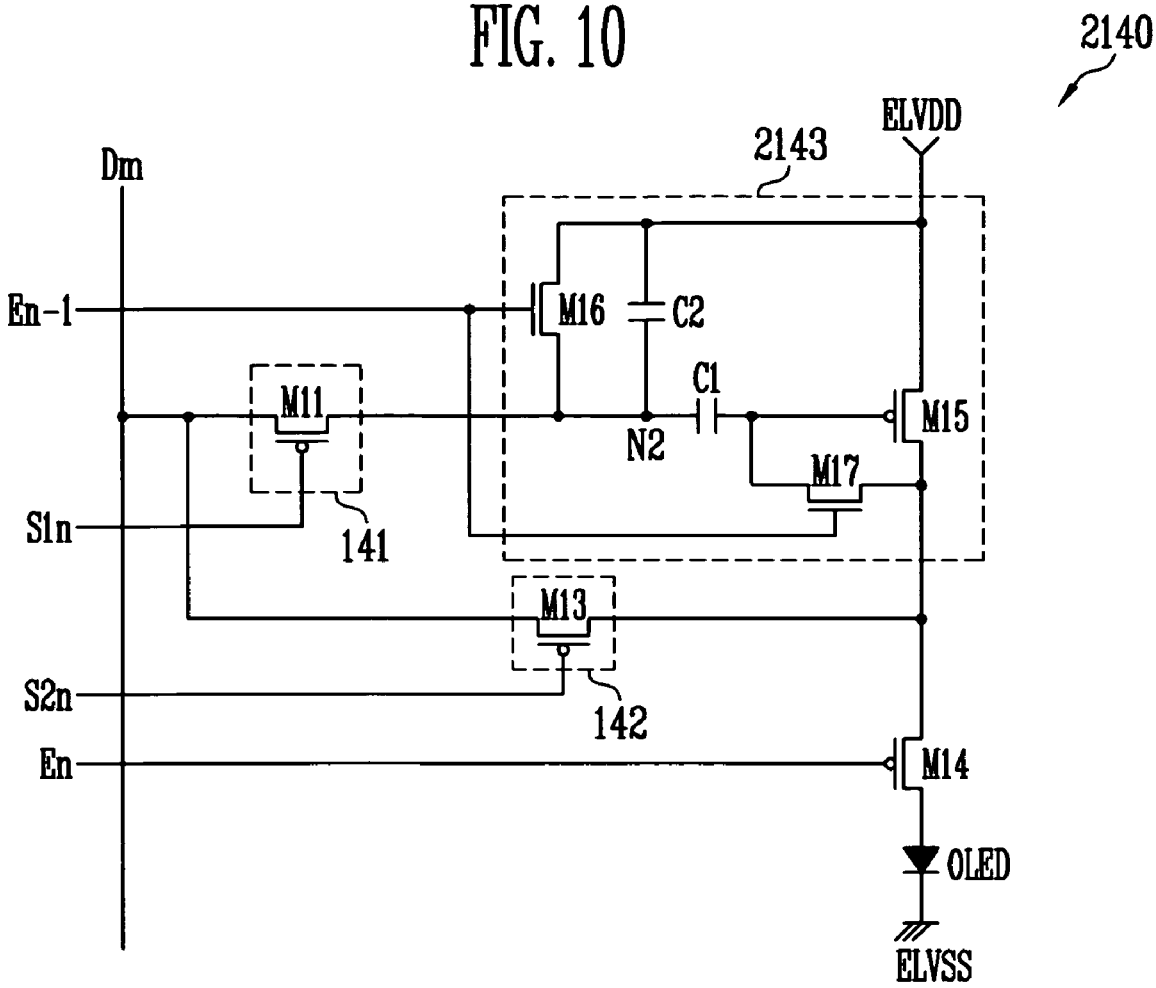
FIG. 10 is a circuit diagram illustrating a second embodiment of the pixel illustrated in FIG. 2.

FIG. 10 is a circuit diagram illustrating a second embodiment of the pixel 140 illustrated in FIG. 2. For the sake of convenience, FIG. 10 exemplarily illustrates a pixel 2140 that is coupled to the $m^{th}$ data line Dm, the $n^{th}$ first scan line S1*n*, the $n^{th}$ second scan line S2*n*, and the $n^{th}$ emission control line En.

Referring to FIG. 10, the pixel 2140 according to an alternative pixel embodiment of the present invention includes a light emitting device OLED, a first switching unit 141, a second switching unit 142, a driver 2143, and a transistor M14 which will be referred to as a fourth transistor M14.

The first switching unit 141 is coupled between the data line Dm and a driver 2143, and supplies a data signal (i.e., first or second gradation voltage Vdata Vdata2) from the data line Dm to the driver 2143. The first switching unit 141 includes a first transistor M11. The first transistor M11 is controlled by the first scan signal transmitted to the $n^{th}$ first scan line S1*n*. If the waveforms of FIG. 4 are applied, then the first transistor M11 is turned on for the duration of the first period of one horizontal period 1H, and turned off at least once during the second period.

The second switching unit 142 is coupled between the data line Dm and the driver 2143, and supplies the pixel current from the driver 2143 to the data line Dm. The second switching unit 142 includes a third transistor M13. The third transistor M13 is controlled by the second scan signal transmitted to the $n^{th}$ second scan line S2*n*. Given the waveform of FIG. 4, the third transistor M13 is turned off for the first period of one horizontal period 1H, and turned on and off alternately with the first transistor M11 for the second period.

The fourth transistor M14 is coupled between the driver 2143 and the light emitting device OLED. The fourth transistor M14 is controlled by an emission control signal transmitted from the $n^{th}$ emission control line En. The emission control signal is supplied overlapping with the first and second scan signals, and has a width equal to or larger than that of the first scan signal. The fourth transistor M14 is turned off during a period while the emission control signal is being supplied, and is turned on for the remaining time.

The driver 2143 supplies the pixel current Ipixel, corresponding to the data signal received from the first switching unit 141, to the second switching unit 142 and the fourth transistor M14. The driver 2143 includes circuit elements to compensate for the threshold voltage of a fifth transistor M15. For example, the driver 2143 is configured as one of various well-known circuits that can compensate for the threshold voltage of a transistor.

The driver 2143 includes a first capacitor C1, a second capacitor C2, the fifth transistor M15, a sixth transistor M16, and a seventh transistor M17.

The first capacitor C1 is coupled between the fifth transistor M15 and the first switching unit 141, and is charged with a voltage corresponding to the threshold voltage of the fifth transistor M15.

The second capacitor C2 is coupled between the first power line supplying the first voltage ELVDD and a second node N2 formed as a common node between the first capacitor C1 and the first switching unit 141. The second capacitor C2 is charged with a voltage corresponding to the data signal.

The fifth transistor M15 is coupled between the first power line supplying the first voltage ELVDD and the fourth transistor M14. The fifth transistor M15 supplies the pixel currents Ipixel corresponding to the voltages charged in the first capacitor C1 and the second capacitor C2 to the second switching unit 142 and to the fourth capacitor M14.

The sixth transistor M16 is coupled between the second node N2 and the first power line supplying the first voltage ELVDD. The sixth transistor M16 is controlled by the emission control signal supplied from the $(n-1)^{th}$ emission control line En−1. The sixth transistor M16 is turned on for a period while the emission control signal En−1 is supplied, and turned off for the remaining period. In order to be on while the emission control signal En−1 is high, the sixth transistor M16 has a different conductive type from the fourth transistor M14. For example, when the fourth transistor M14 is formed as a PMOS transistor, the sixth transistor M16 will be formed as a NMOS transistor, and vice versa.

The seventh transistor M17 is coupled between a gate electrode of the fifth transistor M15 and the second switching unit 142. The seventh transistor M17 is controlled by the emission control signal supplied through the $(n-1)^{th}$ emission control line En−1. The seventh transistor M17 is turned on for the period while the emission control signal is supplied, and turned off for the rest period. In order to be on while the voltage applied to its gate electrode is high, the seventh transistor M17 has the same conductivity type as the sixth transistor M16.

Figure 11:
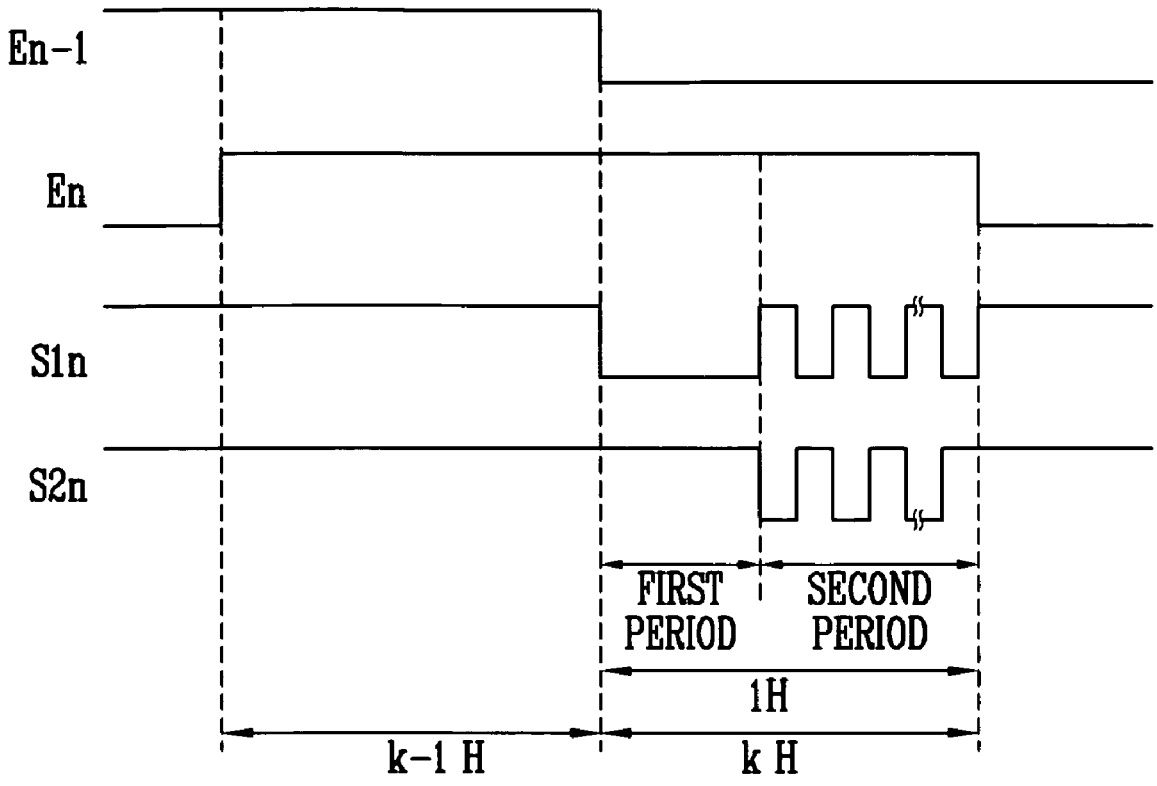
FIG. 11 shows waveforms of signals for driving the pixel circuit illustrated in FIG. 10.

FIG. 11 shows waveforms of signals used for driving the pixel 2140 illustrated in FIG. 10. In the written description of this and the remaining figures, it will be assumed that the emission control signal has a width approximately corresponding two of the one horizontal periods 1H, and the emission control signal supplied to the $(n-1)^{th}$ emission control line is overlapped with the emission control signal supplied to the $n^{th}$ emission control line over the duration of one horizontal period 1H.

Referring to FIG. 11, to demonstrate the operation of the pixel 2140, the emission control signals are supplied to the $(n-1)^{th}$ emission control line En−1 and the $n^{th}$ emission control line En during a $(k-1)^{th}$ horizontal period k−1H (where, k is a natural number) and a $k^{th}$ horizontal period KH.

When the emission control signal is supplied to the $n^{th}$ emission control line En, the fourth transistor M14 is turned off. When the emission control signal is supplied to the $(n-1)^{th}$ emission control line En−1, the sixth transistor M16 and the seventh transistor M17 are turned on. As the sixth transistor M16 is turned on, the voltage of the first power line supplying the first voltage ELVDD is supplied to the second node N2. As the seventh transistor M17 is turned on, the terminals of the fifth transistor M15 are coupled like a diode. As a result, the first voltage ELVDD supplied by the first power line is lowered by the threshold voltage of the fifth transistor M15, and then supplied to the gate terminal of the fifth transistor M15. The first capacitor C1 is charged with a voltage corresponding to the threshold voltage of the fifth transistor M15.

Subsequently, during the $k^{th}$ horizontal period kH, the first scan signal is supplied to the $n^{th}$ first scan line S1*n* and the second scan signal is supplied to the $n^{th}$ second scan line S2*n*. Further, during the $k^{th}$ horizontal period kH, the emission control signal is supplied to the $n^{th}$ emission control line En, but the emission control signal is not supplied to the $(n-1)^{th}$ emission control line En−1.

As the first scan signal is supplied, the first transistor M11 is turned on for the first period of the $k^{th}$ horizontal period KH. When the first transistor M11 is turned on, the datra signal (first gradation voltage Vdata) is applied from the data line Dm to the second node N2 for the duration of the first period. As a result, the second capacitor C2 is charged with a voltage corresponding to the data signal. During the same period, the third transistor M13 receives the second scan signal and is turned off for duration of the first period.

Thereafter, during a part of the second period of the $k^{th}$ horizontal period KH, the first transistor M11 is turned off, and the third transistor M13 is turned on. When the third transistor M13 is turned on, the pixel currents Ipixel corresponding to the voltages charged in the first capacitor C1 and in the second capacitor C2 are supplied to the data line Dm via the fifth transistor M15 and the third transistor M13. Subsequently, the pixel current Ipixel is supplied from the data line Dm to the data driving integrated circuit 129. The data driving integrated circuit 129 receives the pixel current Ipixel and adjusts the voltage level of the data signal, thereby allowing a desired pixel current Ipixel to flow in the pixel 2140. Further, the data driving integrated circuit 129 supplies the adjusted data signal (second gradation voltage Vdata2) having an increased or decreased voltage level to the data line Dm.

Next, the third transistor M13 is turned off, and the first transistor M11 is turned on. As the first transistor M11 is turned on, the adjusted data signal having a increased or decreased voltage level is supplied to the second node N2 via the first transistor M11. As a result, the second capacitor C2 is charged with a voltage corresponding to the adjusted data signal. According to an embodiment of the present invention, the first transistor M11 and the third transistor M13 are alternately turned on and off at least once during the second period, so that the level of voltage charging in the first capacitor C1 is varied, thereby controlling the pixel current Ipixel flowing in the pixel 2140.

Thereafter, during the $(K+1)^{th}$ horizontal period (k+1)H (shown only partially), the fourth transistor M14 is turned on. As the fourth transistor M14 is turned on, the pixel current Ipixel is supplied from the fifth transistor M15 to the light emitting device OLED. The light emitting device OLED emits light corresponding to the received pixel current Ipixel. The pixel current Ipixel flowing to the light emitting device OLED has been adjusted to a desired level, so that the light emitting device OLED emits light with desired brightness.

Figure 12:
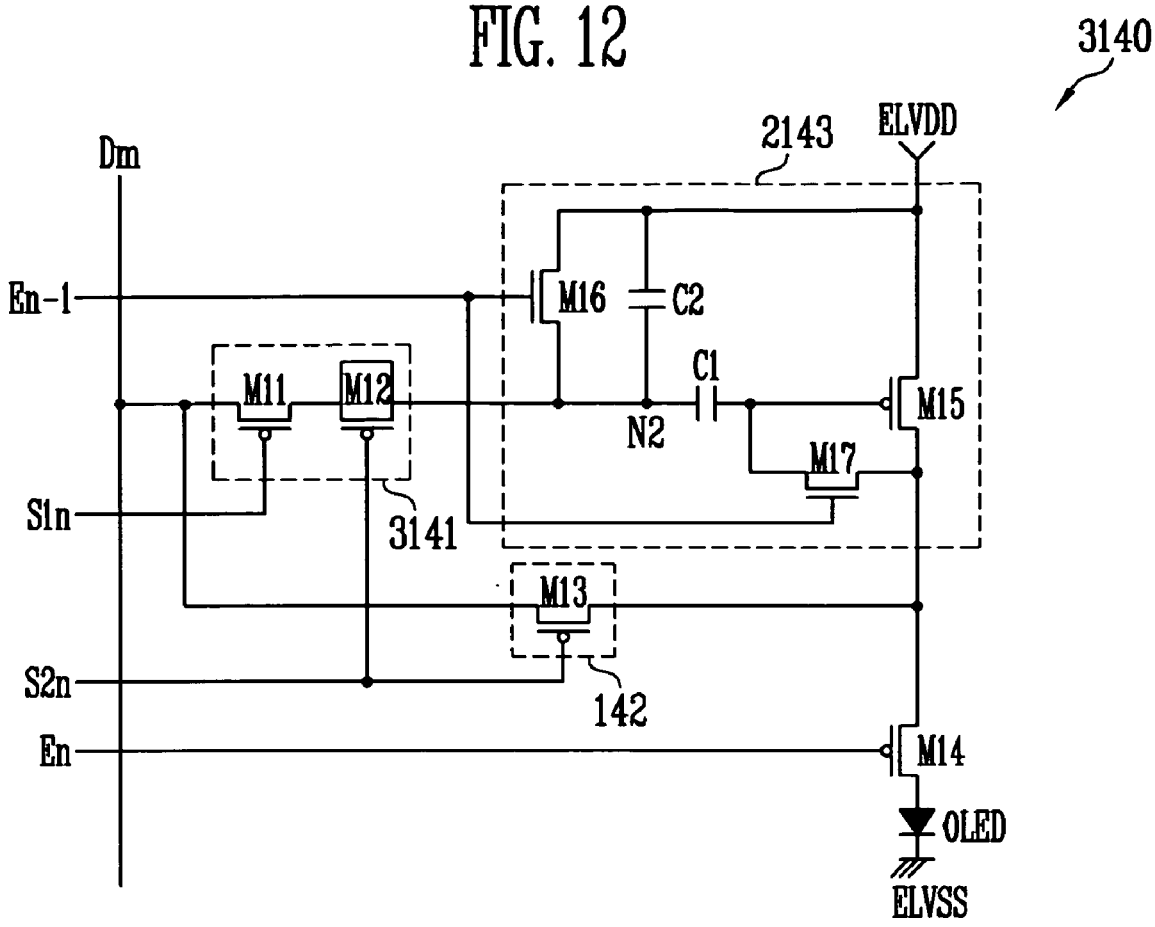
FIG. 12 is a circuit diagram illustrating a third embodiment of the pixel illustrated in FIG. 2.

FIG. 12 is a circuit diagram illustrating a third embodiment of the pixel 140 illustrated in FIG. 2. A pixel 3140 according to the third embodiment of the present invention has the same configuration as that shown in FIG. 10 except the structure of a first switching unit 3141 is different from the first switching unit 141 of the first and second embodiments. Therefore, description of similar parts are omitted.

Referring to FIG. 12, the first switching unit 3141 of the pixel 3140 according to the third embodiment of the present invention includes a first transistor M11 and a second transistor M12. The first transistor M11 is coupled between the data line Dm and the driver 142. The first transistor M11 is controlled by the first scan signal supplied to the $n^{th}$ first scan line S1*n*. That is, the first transistor M11 is turned on for the first period of one horizontal period 1H, and turned on and off at least once for the second period if the waveforms of signals applied are those shown in FIG. 4 for the one horizontal period 1H or in FIG. 11 for the kth horizontal period KH.

The second transistor M12 is coupled between the first transistor M11 and the driver 2143. The second transistor M12 is controlled by the second control signal supplied through the nth second scan line S2*n*. Further, the second transistor M12 includes a first electrode (e.g., source electrode) and a second electrode (e.g., drain electrode), which are electrically coupled to each other. Thus, when the first transistor M11 is turned on, the the data signal is supplied to the driver 2143 regardless of turning on or off second transistor M12. The second transistor M12 is employed for decreasing the switching error of the first transistor M11. In essence, because the second transistor M12 is provided in the first switching unit 3141, the switching error is reduced, thereby improving driving reliability.

Figure 13:
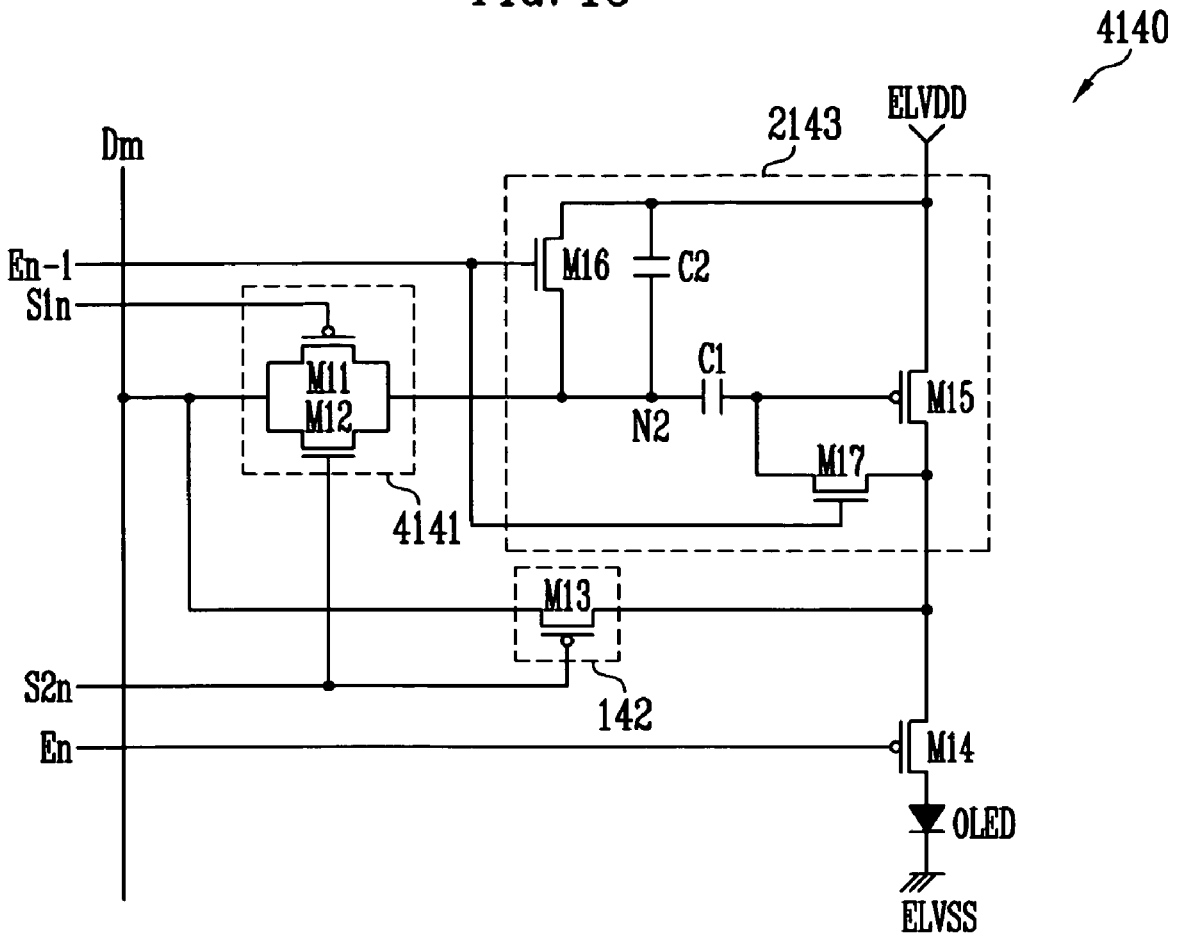
FIGS. 13 and 14 are circuit diagrams illustrating a fourth embodiment of the pixel illustrated in FIG. 2.

FIG. 13 is a circuit diagram illustrating a fourth embodiment of the pixel 140 illustrated in FIG. 2. A pixel 4140 according to the fourth embodiment of the present invention has the same configuration as that shown in the second embodiment in FIG. 10 except the structure of the first switching unit 141 in FIG. 10 and that of a first switching unit 4141 in FIG. 13 are different. For the sake of brevity, description of similar parts are omitted.

Referring to FIG. 13, the first switching unit 4141 of the pixel 4140 according to the fourth embodiment of the present invention includes a first transistor M11 and a second transistor M12, which are coupled to each other as a transmission gate form. The first transistor M11, formed as a PMOS conductivity type, includes a gate electrode coupled to the $n^{th}$ first scan line S1*n*. The second transistor M12, formed as an NMOS conductivity type, includes a gate electrode coupled to the $n^{th}$ second scan line S2*n*. The first scan signal and the second scan signal of both FIG. 4 and FIG. 11 are different in polarity, so that the first transistor M11 and the second transistor M12 are turned on at the same time when the first and second scan signals are supplied. When both transistors are on the data line Dm is electrically coupled with the driver 2143 through this pair of the first and the second transistors M11, M12.

Figure 14:
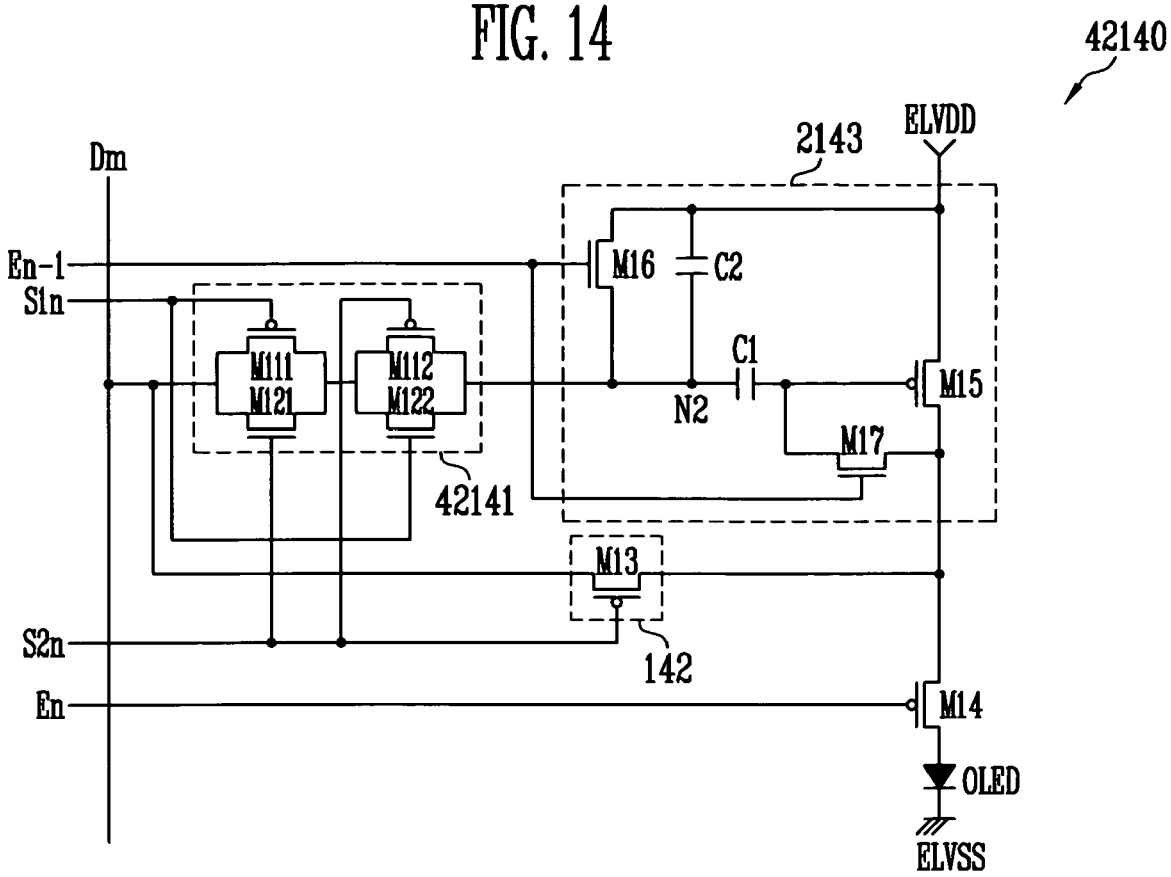

In the case where the first transistor M11 and the second transistor M12 are coupled in the transmission gate form shown, a voltage vs. current curve appears as an approximately straight line and the switching error is minimized. In a variation on the fourth embodiment, shown in FIG. 14, a first switching unit 42141 instead includes transistors M111, M112, M121, M122, which are coupled as a pair of transmission gates. In essence, the first switching unit 4141, 42141 of the fourth embodiment includes at least one NMOS transistor and at least one PMOS transistor, which are coupled in the transmission gate form.

Figure 15:
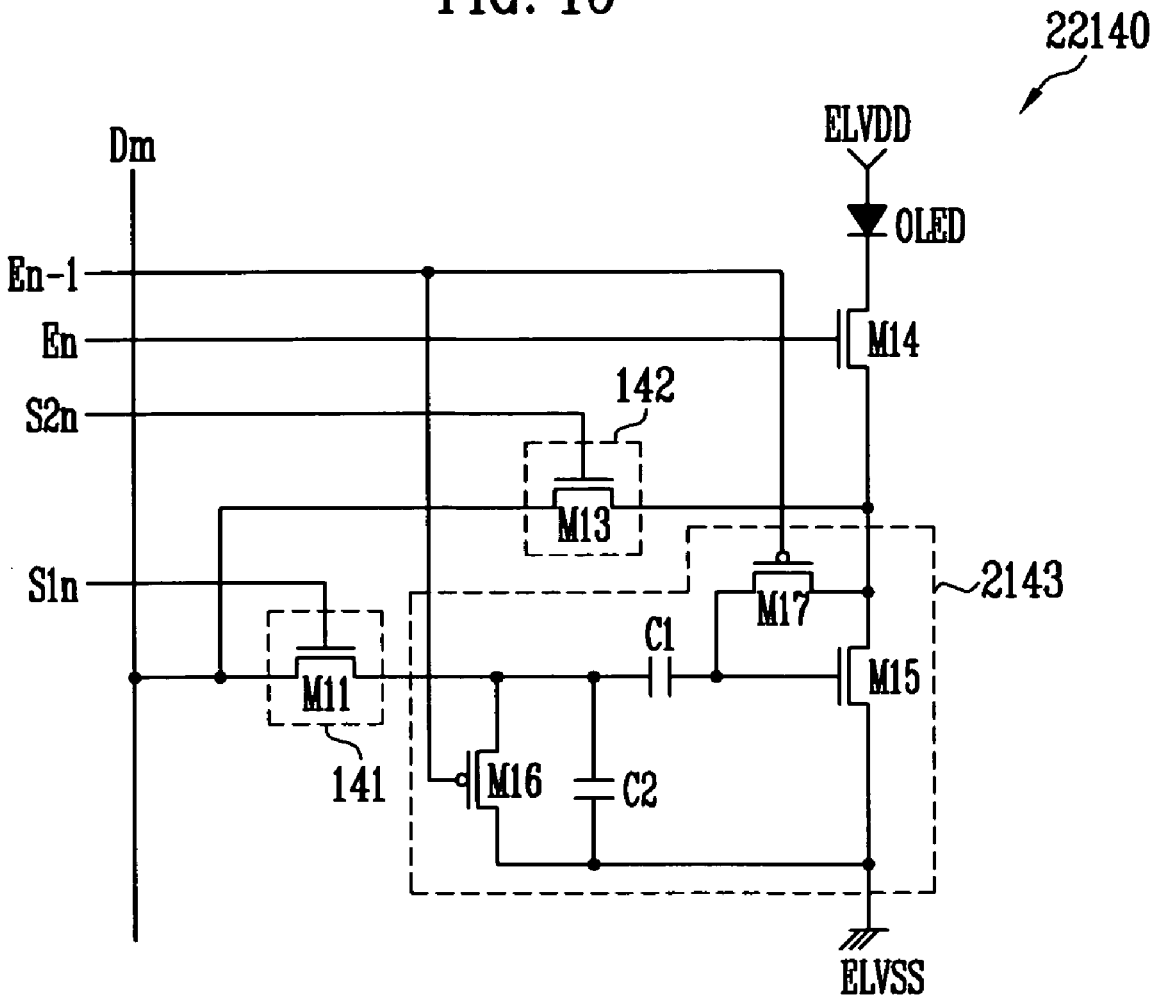
FIG. 15 is a circuit diagram of a pixel including transistors with conductivities different from those illustrated in FIG. 10.

FIG. 15 shows a variation on the second embodiment where the transistors included in the pixels 22140 vary in conductivity type from those of the second embodiment shown in FIG. 10. For example, the pixel 2140 shown in FIG. 10 may include the NMOS transistors instead of the PMOS transistors M11 through M15, and the PMOS transistors instead of the NMOS transistors M16 and M17 giving rise to the pixel 22140 of FIG. 15. In this variation, as known to one skilled in the art, the signals (first scan signal, the second scan signal, the emission control signal, etc.) are merely inversed in their polarity, while the operations of the transistors are not changed.

Figure 16:
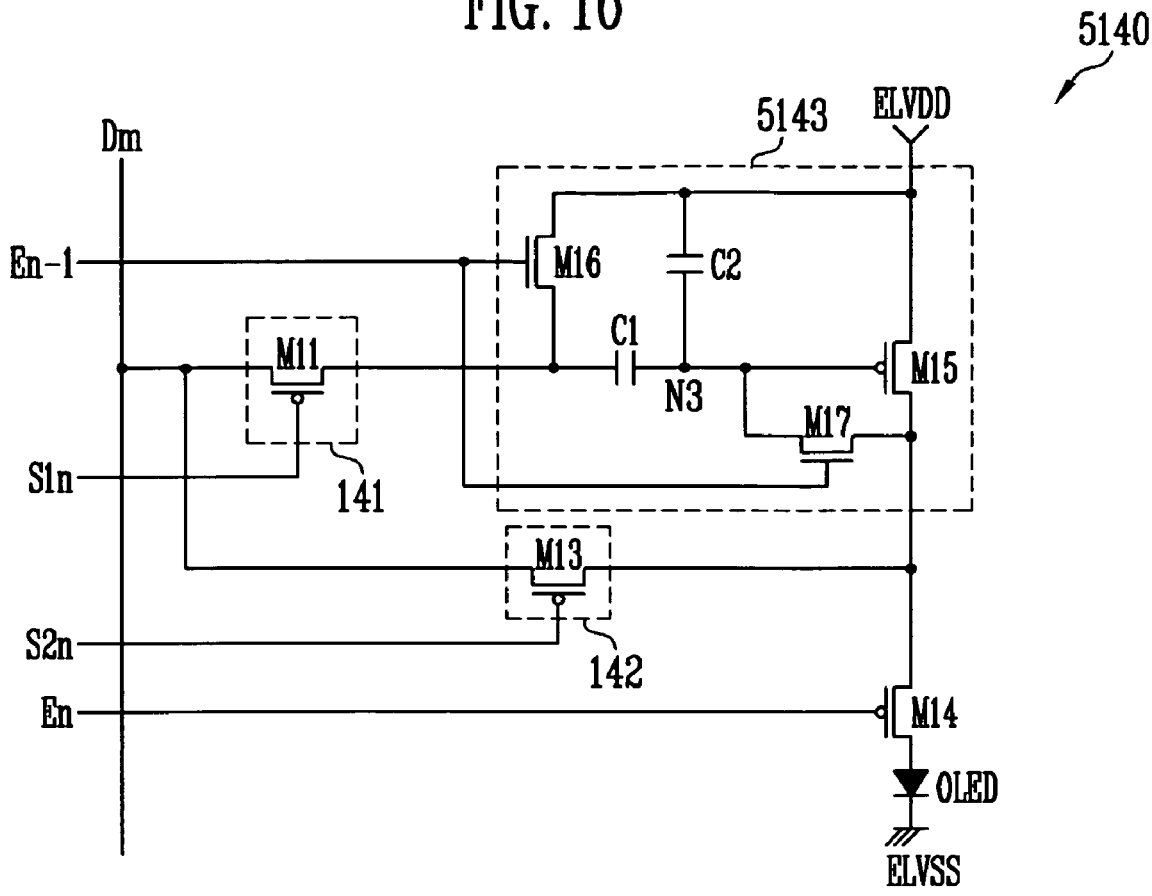
FIG. 16 is a circuit diagram of a fifth embodiment of the pixel illustrated in FIG. 2.

FIG. 16 shows a fifth embodiment of a pixel 5140. According to this embodiment, the second capacitor C2 provided in the driver 2143, shown in pixels 2140, 22140, 3140, 4140, 42140, 22140 of the various embodiments and their variations shown on FIGS. 10, 12, 13, 14, and 15, can be moved. As seen in FIG. 16, in the pixel 5140 of the fifth embodiment, the second capacitor C2 is coupled between the first power line supplying the first voltage ELVDD and a third node N3 formed as a common node between the first capacitor C1 and the fifth transistor M15. Even though the second capacitor C2 is coupled between the third node N3 and the first power line supplying the first voltage ELVDD, the pixel 5140 performs the same function as the pixel 2140 shown in FIG. 10.

Figure 17:
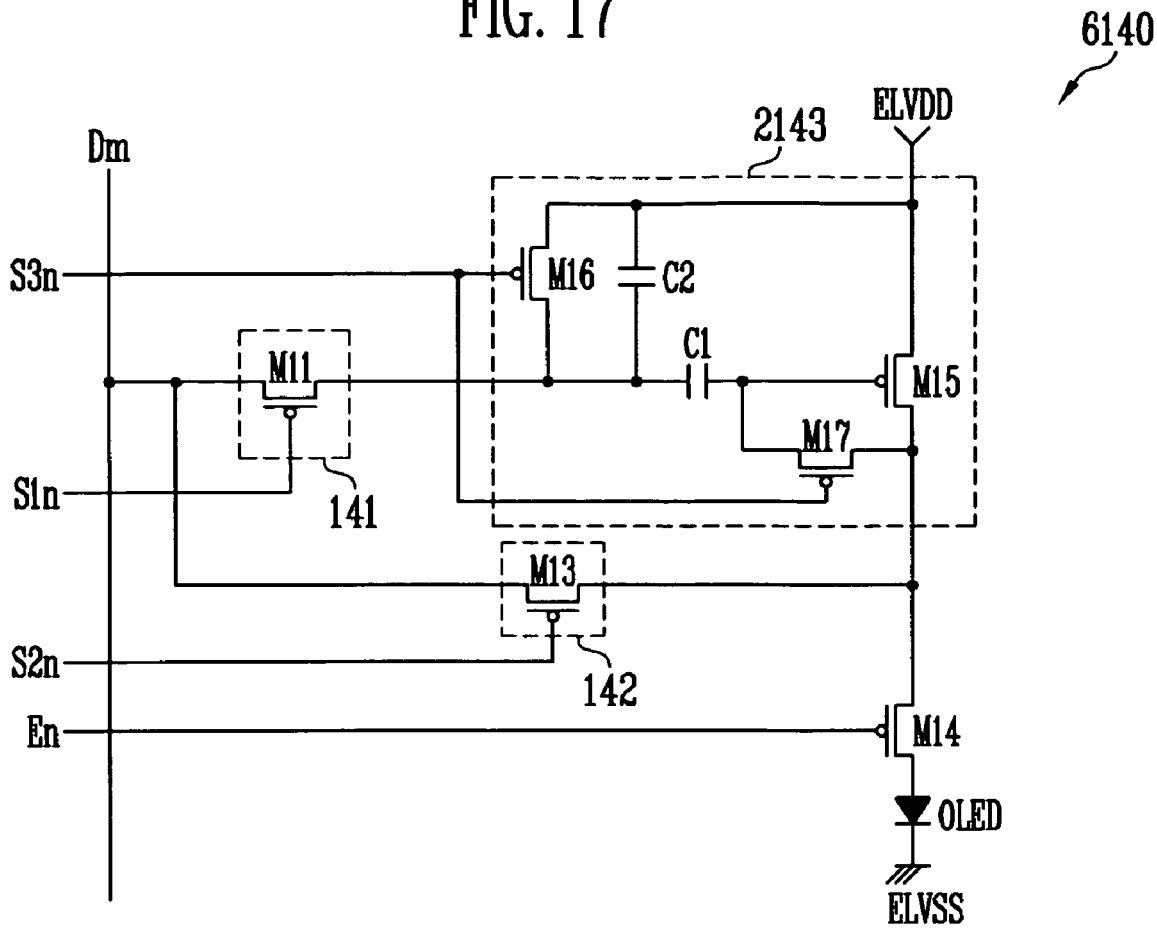
FIG. 17 is a circuit diagram of a sixth embodiment of the pixel illustrated in FIG. 2.

FIG. 17 shows a sixth embodiment of a pixel 6140. According to this embodiment of the present invention, the sixth transistor M16 and the seventh transistor M17 may be coupled to the $n^{th}$ third scan line S3*n* that is additionally provided. In this case, the sixth transistor M16 and the seventh transistor M17 have the same conductivity type as the fourth transistor M14. The sixth transistor M16 and the seventh transistor M17 coupled to the $n^{th}$ third scan line S3*n* are turned on for a period while a third scan signal is supplied through the $n^{th}$ third scan line S3*n*, and are turned off for the remaining time.

Figure 18:
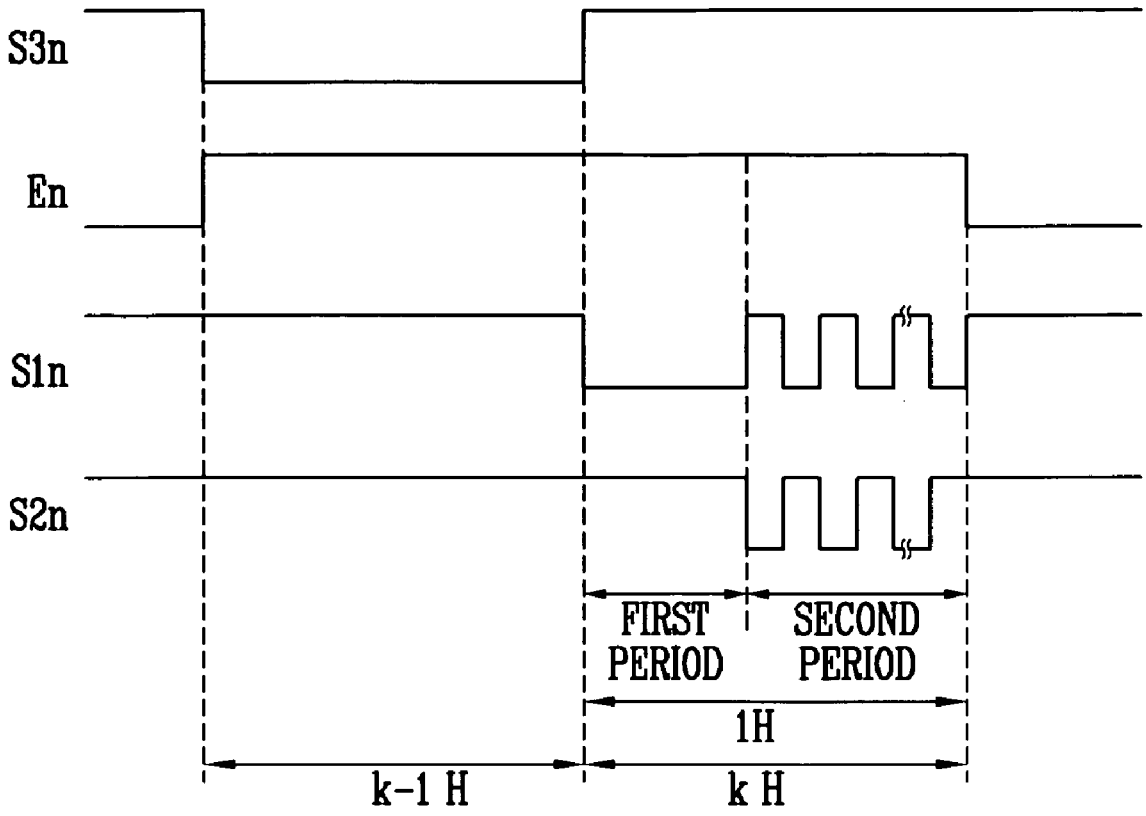
FIG. 18 shows waveforms of signals for driving the pixel illustrated in FIG. 17.

FIG. 18 shows the waveforms of signals for driving the pixel 6140 of FIG. 17. The third scan signal is supplied before the first scan signal is supplied to the $n^{th}$ first scan line S1*n*. For example, when the first scan signal is supplied during the $k^{th}$ horizontal period kH, the third scan signal is supplied during the $(k-1)^{th}$ horizontal period k−1H.

Although exemplary embodiments of the present invention have been shown and described, it would be appreciated by those skilled in the art that changes might be made to these embodiments without departing from the principles and spirit of the invention, the scope of which is defined in the claims and their equivalents.

What is claimed is:

1. A pixel circuit comprising:

a light emitting device;

a driver for supplying a pixel current to the light emitting device corresponding to a data signal supplied from a data line;

a first switching unit coupled between the driver and the data line and turned on during a first period of a horizontal period, the horizontal period being divided into the first period and a second period and turned off and on at least once during the second period of the horizontal period; and a second switching unit coupled between the data line and a common node between the driver and the light emitting device, the second switching unit being turned off during the first period and turned on and off alternately with the first switching unit during the second period, wherein the driver includes:

a first transistor for generating the pixel current from a voltage supplied by a first power line, the pixel current corresponding to the data signal and being supplied to the light emitting device;

a first capacitor coupled between the first transistor and the first switching unit capable of being charged with a voltage corresponding to a threshold voltage of the first transistor; and a second capacitor having a first terminal coupled to a node between the first capacitor and the first switching unit, and a second terminal coupled to the first power line and chargeable with a voltage corresponding to the data signal.

2. The pixel circuit of claim 1, wherein the data signal is supplied to the driver when the first switching unit is turned on, and the pixel current is supplied to the data line when the second switching unit is turned on.

3. The pixel circuit of claim 2, further comprising:

a first scan line coupled to the first switching unit and for supplying a first scan signal to control the first switching unit to be turned on during the first period and turned off and on at least once during the second period; and a second scan line coupled to the second switching unit and for supplying a second scan signal to control the second switching unit to be turned off during the first period and turned on and off alternately with the first switching unit during the second period.

4. The pixel circuit of claim 3, wherein the first switching unit includes:

a second transistor coupled between the data line and the driver and controlled by the first scan line; and a third transistor coupled between the first transistor and the driver and controlled by the second scan line, the third transistor having a drain electrode and a source electrode which are electrically coupled to each other.

5. The pixel circuit of claim 3, wherein the first switching unit includes:

a second transistor provided as a PMOS transistor and controlled by the first scan line; and a third transistor provided as a NMOS transistor coupled with the second transistor in a transmission gate form and controlled by the second scan line.

6. The pixel circuit of claim 5, wherein the first switching unit further includes:

a fourth transistor provided as a PMOS transistor and controlled by the second scan line; and a fifth transistor provided as a NMOS transistor coupled with the second transistor in a transmission gate form and controlled by the first scan line, a transmission gate being formed by the fourth transistor and the fifth transistor coupled between the driver and a transmission gate being formed by the second transistor and the third transistor.

7. The pixel circuit of claim 3, wherein the second capacitor is coupled between the first power line and a first node formed as a common node between the first capacitor and the first switching unit.

8. The pixel circuit of claim 7, wherein the driver further includes:

a second transistor coupled between the first node and the first power line, the second transistor being turned on before the first scan signal and the second scan signal are supplied; and a third transistor coupled between a gate electrode of the first transistor and a second electrode of the first transistor, the third electrode being turned on when the second transistor is turned on.

9. The pixel circuit of claim 8, further comprising a fourth transistor coupled between the driver and the light emitting device, the fourth transistor being turned off while the first scan signal is supplied and turned on otherwise.

10. A light emitting display comprising:

a data driver for supplying a data signal to a data line;

a scan driver for supplying a first scan signal, a second scan signal, and an emission control signal to a first scan line, a second scan line, and an emission control line, respectively; and a pixel portion having pixels which are coupled to the data line, the first scan line, the second scan line, and the emission control lines, the pixels having the pixel circuit of claim 1.

11. A light emitting display comprising:

a data driver for supplying a data signal to a data line;

a scan driver for supplying a first scan signal, a second scan signal, and an emission control signal to a first scan line, a second scan line, and an emission control line, respectively; and a pixel portion having pixels which are coupled to the data line, the first scan line, the second scan line, and the emission control lines, the pixels having the pixel circuit of claim 2.

12. A light emitting display comprising:

a data driver for supplying a data signal to a data line;

a scan driver for supplying a first scan signal, a second scan signal, and an emission control signal to a first scan line, a second scan line, and an emission control line, respectively; and a pixel portion having pixels which are coupled to the data line, the first scan line, the second scan line, and the emission control lines, the pixels having the pixel circuit of claim 3.

13. A light emitting display comprising:

a data driver for supplying a data signal to a data line;

a scan driver for supplying a first scan signal, a second scan signal, and an emission control signal to a first scan line, a second scan line, and an emission control line, respectively; and a pixel portion having pixels which are coupled to the data line, the first scan line, the second scan line, and the emission control lines, the pixels having the pixel circuit of claim 4.

14. A light emitting display comprising:

a data driver for supplying a data signal to a data line;

a scan driver for supplying a first scan signal, a second scan signal, and an emission control signal to a first scan line, a second scan line, and an emission control line, respectively; and a pixel portion having pixels which are coupled to the data line, the first scan line, the second scan line, and the emission control lines, the pixels having the pixel circuit of claim 5.

15. A light emitting display comprising:

a data driver for supplying a data signal to a data line;

a scan driver for supplying a first scan signal, a second scan signal, and an emission control signal to a first scan line, a second scan line, and an emission control line, respectively; and a pixel portion having pixels which are coupled to the data line, the first scan line, the second scan line, and the emission control lines, the pixels having the pixel circuit of claim 6.

16. A light emitting display comprising:

a data driver for supplying a data signal to a data line;

a scan driver for supplying a first scan signal, a second scan signal, and an emission control signal to a first scan line, a second scan line, and an emission control line, respectively; and a pixel portion having pixels which are coupled to the data line, the first scan line, the second scan line, and the emission control lines, the pixels having the pixel circuit of claim 8.

17. A light emitting display comprising:

a data driver for supplying a data signal to a data line;

a scan driver for supplying a first scan signal, a second scan signal, and an emission control signal to a first scan line, a second scan line, and an emission control line, respectively; and a pixel portion having pixels which are coupled to the data line, the first scan line, the second scan line, and the emission control lines, the pixels having the pixel circuit of claim 9.

* * * * *